US005240109A

United States Patent [19]

Weder et al.

[11] Patent Number: 5,240,109

[45] Date of Patent: * Aug. 31, 1993

[54] SHIPPING CARTON FOR FLORAL GROUPING ASSEMBLIES

[75] Inventors: Donald E. Weder, Highland; William F. Straeter, Breese; Joseph G. Straeter, Highland, all of Ill.

[73] Assignee: Highland Supply Corporation, Highland, Ill.

[ * ] Notice: The portion of the term of this patent subsequent to Mar. 3, 2009 has been disclaimed.

[21] Appl. No.: 892,441

[22] Filed: Jun. 2, 1992

Related U.S. Application Data

[63] Continuation of Ser. No. 831,767, Feb. 5, 1992, Pat. No. 5,148,918, which is a continuation-in-part of Ser. No. 692,329, Apr. 26, 1991, Pat. No. 5,092,465.

[51] Int. Cl.[5] ..... B65D 85/50; B65D 85/52

[52] U.S. Cl. ..... 206/423; 206/813

[58] Field of Search ..... 206/423, 813

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren . | |
| 2,373,634 | 4/1945 | Wagner | 206/813 X |
| 2,744,624 | 5/1956 | Hoogstoel et al. . | |
| 3,322,323 | 5/1967 | Greene et al. | 206/813 X |
| 3,389,784 | 6/1968 | Hendricks et al. | 206/813 X |
| 3,883,990 | 5/1975 | Stidolph . | |
| 3,924,354 | 12/1975 | Gregoire . | |
| 4,053,049 | 10/1977 | Beauvais . | |
| 4,396,120 | 8/1983 | Morita . | |
| 4,470,508 | 9/1984 | Yen | 206/813 X |

FOREIGN PATENT DOCUMENTS

| | | | |
|---|---|---|---|
| 192843 | 11/1957 | Austria | 206/813 |
| 26878 | of 1913 | United Kingdom | 206/813 |

*Primary Examiner*—William I. Price

*Attorney, Agent, or Firm*—Dunlap, Codding & Lee

[57] ABSTRACT

A shipping carton including a box assembly and a plurality of floral grouping assemblies. The box assembly has a inner surface partially enclosing a retaining space. An adhesive or cohesive is applied to at least a portion of the inner surface of the box assembly. The floral grouping assemblies are disposed in the retaining space and a portion of each of the floral grouping assemblies is removably and adhesively or cohesively connected to the box assembly for preventing substantial movement of the floral grouping assemblies during shipment.

60 Claims, 11 Drawing Sheets

SHIPPING CARTON FOR FLORAL GROUPING ASSEMBLIES

RELATED REFERENCES

This is a continuation of U.S. Ser. No. 831,767 entitled "SHIPPING CARTON FOR FLORAL GROUPING ASSEMBLIES", filed on Feb. 5, 1992, which is a continuation-in-part of U.S. Ser. No. 692,329, filed on Apr. 26, 1991, entitled "SHIPPING CARTON FOR FLORAL GROUPING ASSEMBLIES", now U.S. Pat. No. 4,092,465, issued on Mar. 3, 1992.

FIELD OF THE INVENTION

The present invention generally relates to a box containing floral groupings wherein adhesive is applied to a portion of the box and/or a portion of a box lid and the floral grouping assemblies are disposed in the box and positioned so that the adhesive removably and adhesively connects the floral grouping assemblies to the box or box lid for substantially preventing movement of the floral grouping assemblies in the box during shipment.

DESCRIPTION OF THE PREFERRED EMBODIMENTS

Figure 1:
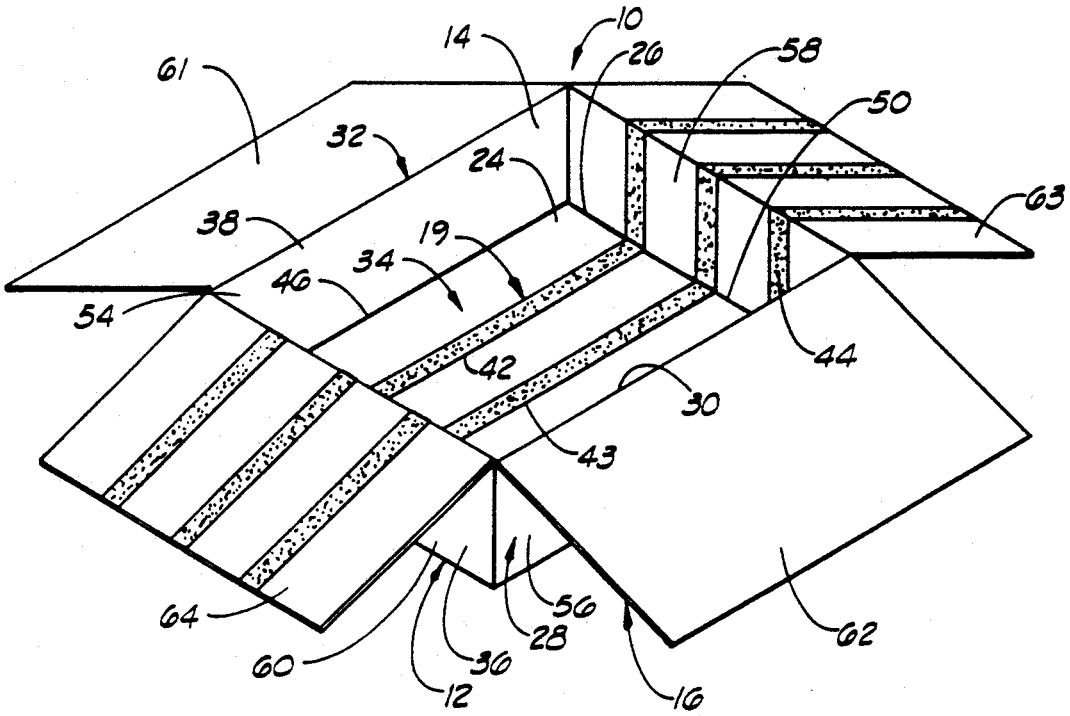
FIG. 1 is a partial perspective view of a box assembly comprising a box and a box lid constructed in accordance with the present invention.
Figure 2:
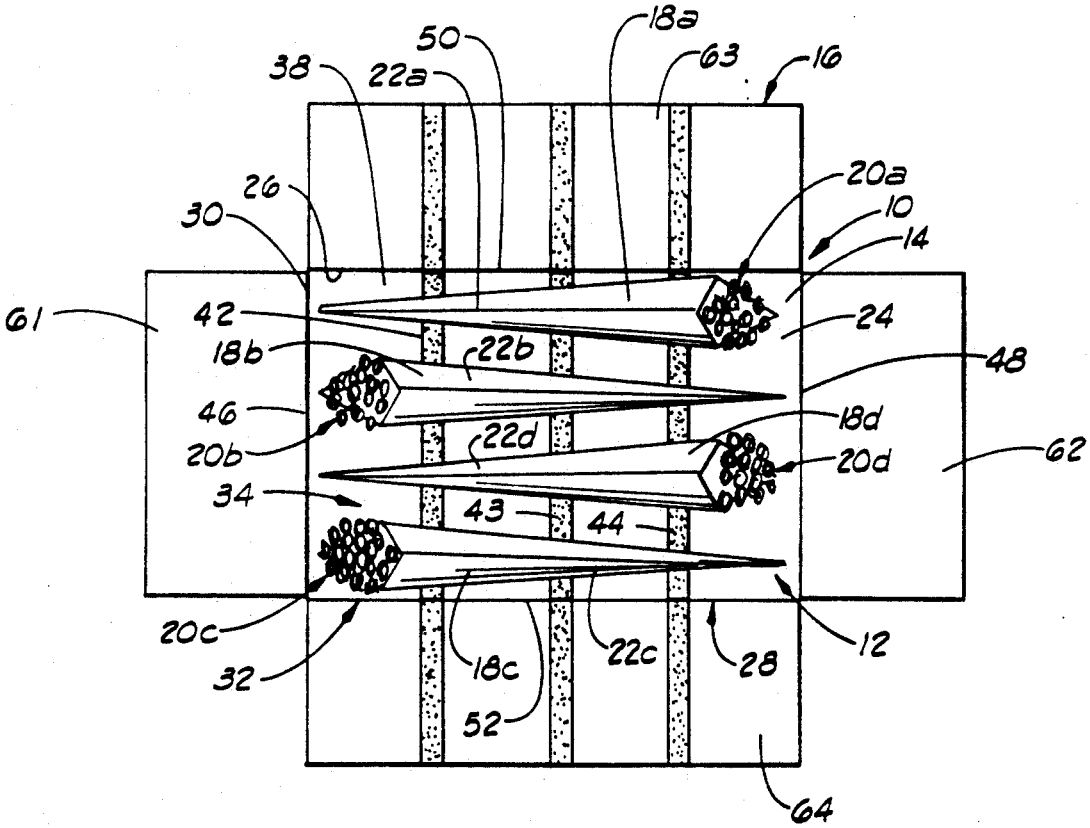
FIG. 2 is a partial elevational view of the box assembly of FIG. 1 showing a plurality of floral grouping assemblies disposed in the box.

Shown in FIGS. 1 and 2 is a shipping carton which is constructed in accordance with the present invention and designated by the general reference numeral 10. The shipping carton includes a box assembly 12. The box assembly 12 comprises a box 14 and a box lid 16.

The box assembly 12 is particularly shaped and sized to accommodate a plurality of floral grouping assemblies 18 (FIG. 2) with the various floral grouping assemblies being designated in FIG. 2 by the respective reference numerals 18*a*, 18*b*, 18*c* and 18*d*. The box assembly 12 includes an adhesive 19 applied to a portion of the box assembly 12.

In operation, the floral grouping assemblies 18 are disposed in the box 14. The adhesive 19 is positioned on the box assembly 12 such that the adhesive 19 removably and adhesively connects the floral grouping assemblies 18 to a portion of the box assembly 12 for substantially preventing movement of the floral grouping assemblies 18 in the box 14 during movements of the box 14 or, more particularly, during movements of the box 14 during shipment with the floral grouping assemblies 18 contained therein Each floral grouping assembly 18 comprises a floral grouping 20 (FIG. 2) with the individual floral groupings 20 being specifically designated in FIG. 2 by the reference numerals 20*a*, 20*b*, 20*c* and 20*d*. Each floral grouping assembly 18 also comprises a sleeve 22 which may be constructed of paper or other suitable material, with each sleeve being designated by the specific reference numerals 22*a*, 22*b*, 22*c* and 22*d* in FIG. 2. Each sleeve 22 is disposed generally about a lower end portion of one of the floral groupings 18. Sleeves which are constructed to be disposed about lower end portions of floral groupings or about entire floral groupings such as the sleeve 22 are well known in the art and a detailed description of the construction and operation of such sleeves is not deemed necessary herein.

The term "floral grouping" as used herein means cut fresh flowers, artificial flowers, other fresh and/or artificial plants or other floral materials and may include other secondary plants and/or ornamentation which add t the aesthetics of the overall floral grouping.

The box 14 comprises a base 24 having an outer periphery 26. The side walls 28 are connected to the base 24, and the side walls 28 extend about the outer periphery 26 of the base 24. Each of the side walls 28 extends a distance about perpendicularly from the base 24 with the side walls 28 terminating with an upper end 30 forming an open upper end 32 of the box 14. The side walls 28 and the base 24 cooperate to partially enclose a retaining space 34.

The box 14 has an outer surface 36 and an inner surface 38. The outer and the inner surfaces 36 and 38 each are formed by portions of the base 24 and portions of the side walls 28.

The adhesive 19 more particularly comprises a pair of three adhesive strips 42, 43 and 44. The adhesive strip 42 extends along portions of the inner surface 38 formed by the side walls 28 and extends over a portion of the inner surface 38 formed by the base 24. The adhesive strip 43 also extends along a portion of the inner surface 38 formed by the side walls 28 and over a portion of the inner surface 38 formed by the base 24. The adhesive strip 44 extends along a portion of the inner surface 38 formed by the side walls 28 over a portion of the inner surface 38 formed by the base 24. The adhesive strip 42 is spaced a distance from the adhesive strip 43, and the adhesive strip 43 is spaced a distance from the adhesive strip 44.

The base 24 more particularly comprises a first end 46, a second end 48, a first side 50 and a second side 52. The base 24 generally is rectangularly shaped. As shown in FIG. 1, the side walls 28 more particularly comprise a first end wall 54, a second end wall 56, a first side wall 58 and a second side wall 60. The first end wall 54 is connected to the base 24 and extends generally along the first end 46 of the base 24. The second end wall 56 is connected to the base 24 and extends generally along the second end 48 of the base 24. The first side wall 58 is connected to the base 24 and extends generally along the first side 50 of the base 24. The second side walls 60 is connected to the base 24 and extends generally along the second side 52 of the base 24. The first end wall 54, the second end wall 56, the first side 58 and the second side wall 60 are interconnected to form the continuous side wall 28 extending about the outer periphery 26 of the base 24.

The adhesive strip 42 more particularly extends along a portion of the first side wall 58, along a portion of the base 24 and along a portion of the second side wall 60. The adhesive strip 43 more particularly extends along a portion of the first side wall 58, along a portion of the base 24 and along a portion of the second side wall 60. The adhesive strip 44 more particularly extends along a portion of the first side wall 58, along a portion of the base 24 and along a portion of the second side wall 60.

The box lid 16 comprises a first lid flap 61, a second lid flap 62, a third lid flap 63 and a fourth lid flap 64. The first lid flap 61 is connected to an upper end of the first end wall 54, the first lid flap 61 extending along the entire length of the first end wall 54 and extending a distance therefrom. The second lid flap 62 is connected to an upper end of the second end wall 56 and extends along the entire length of the upper end of the second end wall 56 and a distance therefrom. The third lid flap 63 is connected to an upper end of the first side wall 58 and extends along the entire length of the first side wall and a distance therefrom. The fourth lid flap 64 is connected to an upper end of the second side wall 60 and extends along the entire length of the second side wall 60 and a distance therefrom. The lid flaps 61, 62, 63 and 64 are shown in FIGS. 1 and 2 in the opened position wherein each of the lid flaps 61, 62, 63 and 64 are removed from the opened upper end 32 of the box 14.

Each of the lid flaps 61, 62, 63 and 64 is movable to a position wherein each of the lid flaps 61, 62, 63 and 64 extends over a portion of the opened upper end 32 of the box 14 and generally over at least a portion of the retaining space 34. The lid flaps 61, 62, 63 and 64 cooperate with the box 14 to substantially enclose and encompass the retaining space 34 in the closed position of the lid flaps 61, 62, 63 and 64.

A portion of the adhesive strips 42, 43 and 44 extend over the third lid flap 63 and another portion of the adhesive strips 42, 43 and 44 extend over a portion of the fourth lid flap 64.

After the floral groupings 18 have been disposed in the retaining space 34, the third and the fourth lid flaps 63 and 64 are moved to the closed position wherein the portions of the adhesive strips 42, 43 and 44 on each of the respective third and fourth lid flaps 63 and 64 contactingly engages the sleeves 22 of the floral grouping assemblies 18. The portions of the adhesive strips 42, 43 and 44 on the base 24 also engages the sleeves 22 of the floral groupings assemblies 18 for adhesively connecting the floral groupings 22 to the base 24 of the box 14. The portions of the adhesive strips 42, 43 and 44 on the third and fourth lid flaps 63 and 64 also engages and adhesively connects portions of the sleeves 22 to the third and fourth lid flaps 63 and 64. The adhesive strips 42, 43 and 44 on the base 24 and the third and fourth lid flaps 63 and 64 cooperate to adhesively and releasably connect the floral grouping assemblies 18 to the box 14 and to portions of the box lid 16 for substantially preventing movement of the floral grouping assemblies in the box assembly 12 during shipment of the box assembly 12.

After the third and fourth lid flaps 63 and 64 have been moved to the closed position, the first and the second lid flaps 61 and 62 then each are moved to the closed position generally overlaying the third and fourth lid flaps 63 and 64. The first and second lid flaps 61 and 62 then may be secured in this closed position via an adhesive tape or other securing means thereby securing all of the lid flaps 61, 62, 63 and 64 in the closed position covering the floral grouping assemblies 18.

EMBODIMENT OF FIGS. 3 AND 4

Figure 3:
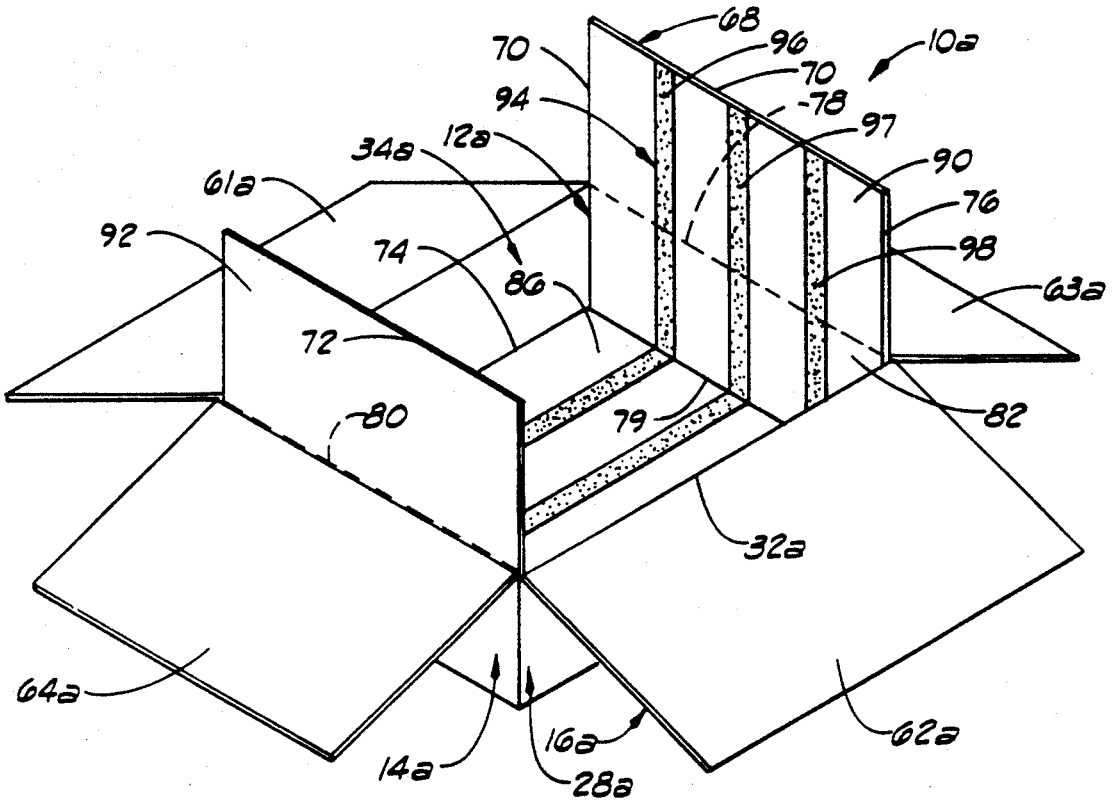
FIG. 3 is a partial elevational view of a modified box assembly wherein the box assembly comprises a box lid, a box and wherein the box comprises a box insert.

Shown in FIG. 3 is a modified box assembly 12*a*. The box assembly 12*a* includes a box 14*a* which is constructed exactly like the box 14 shown in FIGS. 1 and 2 and described in detailed before, except the box 14*a* does not include adhesive or adhesive strips on any portion thereof like the adhesive 19 comprised of the adhesive strips 42, 43 and 44 on the box 14, and the box lid 16 does not include adhesive or adhesive strips on any portion thereof like the adhesive 19 comprised of the adhesive strips 42, 43 and 44 on the third and fourth lid flaps 63 and 64 of the box lid 16.

Figure 4:
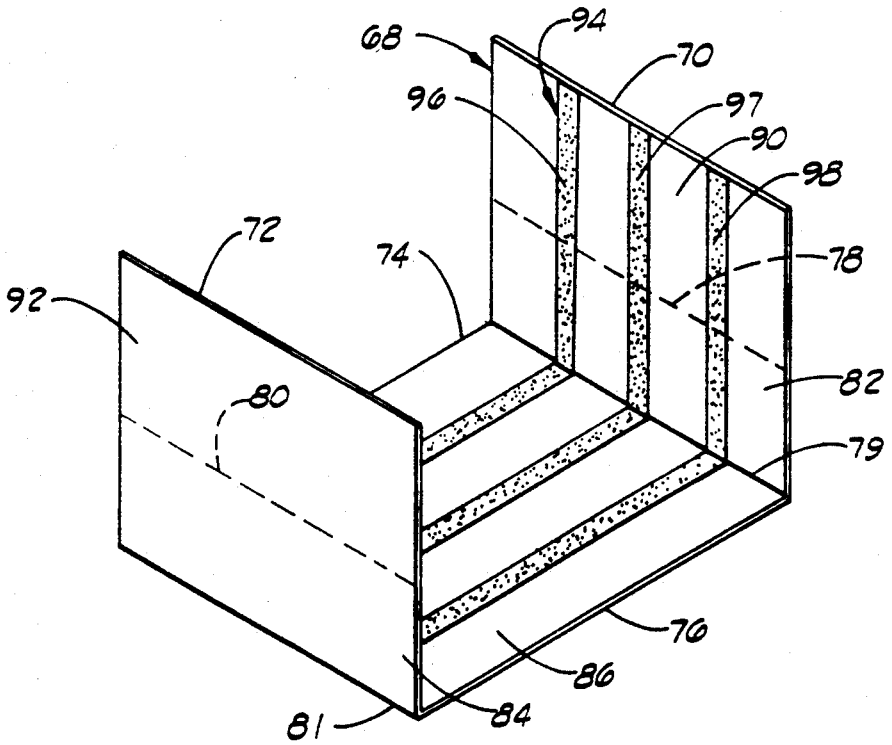
FIG. 4 is a partial elevational view of the box insert shown in FIG. 3.

The box assembly 12*a* includes a box insert 68. As shown in FIGS. 3 and 4, the box insert 68 is generally rectangularly shaped and has a first side 70, a second side 72, a first end 74 and a second end 76. A first fold line 78 is formed on the box insert 68 extending generally between the first and the second ends 74 and 76 and spaced a distance from the first side 70. The box insert 68 also includes a second fold line 80 extending generally between the first and the second ends 74 and 76 and spaced a distance from the second side 72. The box insert 68 also includes a third fold line 79 and a fourth fold line 81. Each of the third and fourth fold lines 79 and 81 extend generally between the first end 74 and the second end 76 of the box insert 68. The third and fourth fold lines 79 and 81 are spaced a distance apart.

The first and third fold lines 78 and 79 are formed in the box insert 68 such that a portion of the box insert 68 extending between the first and the third fold lines 78 and 79 forms a first side wall portion 82 which is foldable in an upwardly direction extending generally perpendicularly from the remaining portion of the box insert 68. The second and the fourth fold lines 80 and 81 are formed in the box insert 68 such that a portion of the box insert 68 extending generally between the second and the fourth fold lines 80 and 81 forms a second side wall portion 84 which is foldable to a position wherein the second side wall portion 84 extends generally perpendicularly from the remaining portion of the box insert 68. The portion of the box insert 68 generally between the third fold line 79 and the forth fold line 81 forms a base portion 86.

The box insert 68 also include an inner surface 90 and an outer surface 92. An adhesive 94 is disposed on the inner surface 90 of the box insert 68. The adhesive 94 more particularly comprises three adhesive strips 96, 97 and 98. The adhesive strips 96, 97 and 98 are spaced a distance apart. Each of the adhesive strips 96, 97 and 98 extends generally between the first and the second side 70 and the second side 72 of the box insert 68.

In operation, the box insert 68 initially is folded along the third and forth fold lines 79 and 81. In this position, the box inserts 68 is disposed in the retaining space 34*a* of the box 14*a* with the outer surface 92 of the box insert 68 formed by the base portion 86 being disposed generally adjacent the inner surface 38*a* of the box 14*a*. The first side wall portion 82 extends generally along the first side wall of the box 14*a* and the second side wall portion 84 of the box insert 68 extends generally along the second side wall of the box 14*a*. The base portion 86 of the box insert 68 extends generally over the base of the box 14*a*. In this embodiment, the base portion 86 and the first and the second side wall portions 82 and 84 cooperate to form a portion of the retaining space 34*a*. The floral grouping assemblies 18 are disposed in the retaining space 34*a* and positioned generally on the box insert 68*a*, or more particularly, positioned generally on the base portion 86 of the box insert 68*a*. The adhesive strips 96, 97 and 98 removably and adhesively connect each of the floral grouping assemblies 18 to the box insert for substantially preventing movement of the floral grouping assemblies in the box 14*a* during movements or shipment of the box 14*a* in a manner like that described before with respect to the box assembly 12 shown in FIGS. 1 and 2.

The portion of the box insert 68 generally between the first fold line 78 and the first side 70 forms a lid flap portion of the box insert and the portion of the box insert 68 generally between the second fold line 80 and the second side 72 of the box insert 68 forms another lid portion of the box insert 68. After the floral grouping assemblies have been disposed in the retaining space 34*a*, the lid flap portions of the box insert then are folded along the respective fold line 78 and 82 to a position wherein the lid flap portions of the box inserts extend generally over the open upper end 32*a* of the box 14*a*. The portions of the adhesive strips 96, 97 and 98 extending over the lid flap portions of the box insert 68 extend over the floral grouping assemblies 18 and removably and adhesively connect each of the floral grouping assemblies to the lid flap portions of the box insert 68 for cooperating to substantially prevent movement of the floral grouping assemblies 18 and the box 14*a* during movements or shipment of the box 14*a* in a manner like that described before with respect to the box assembly 12 shown in FIGS. 1 and 2.

Figure 5:
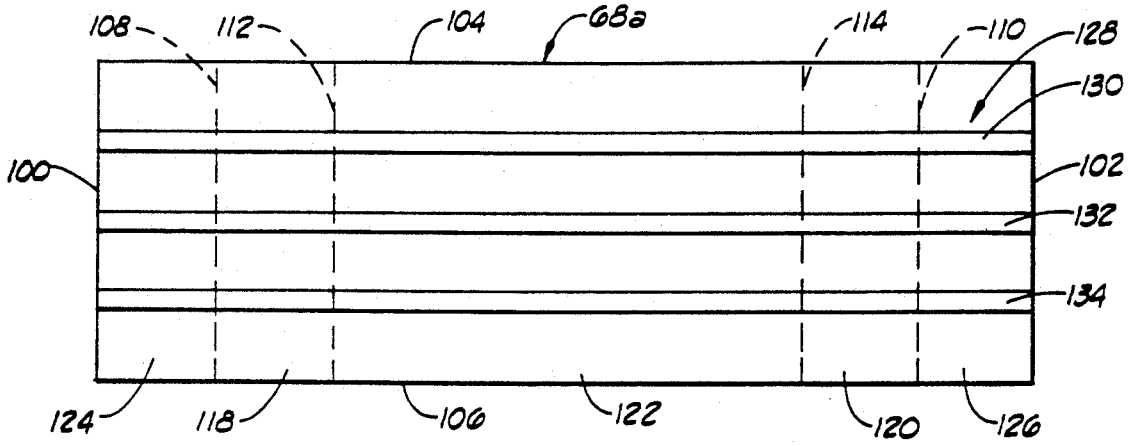
FIG. 5 is a plan view of a modified box insert which may be utilized with the box shown in FIG. 3.

After the lid flap portions of the box insert 68 have been moved to the closed position extending generally over the open upper end 32*a*, the lid flaps 61*a*, 62*a*, 63*a* and 64*a* are moved to the closed position for closing the open upper end 32*a* of the box 14*a*. *lcl EMBODIMENT OF FIG. 5*

Shown in FIG. 5 is a modified box insert 68*a*. The box insert 68*a* has a first end 100, a second end 102, a first side 104 and a second side 106. A first fold line 108 is formed on the box insert 68*a* extending generally between the first and the second sides 104 and 106. The first fold line is spaced a distance from the first end 100 of the box insert 68*a*. A second fold line 110 is formed in the box insert 68*a* extending generally between the first and the second sides 104 and 106. The second fold line 110 is spaced a distance from the second end 102 of the box insert 68*a*. A third fold line 112 is formed in the box insert 68*a* extending generally between the first and the second sides 104 and 106. The third fold line 112 is spaced a distance from the first fold line 108. A fourth fold line 114 is formed in the box insert 68*a* extending generally between the first and the second sides 104 and 106. The fourth fold line 114 is spaced a distance from the second fold line 110.

The first fold line 108 is spaced a distance from the third fold line 112 forming a first side wall portion 118 extending generally between the first and the third fold lines 108 and 112. The fourth fold line 114 is spaced a distance from the second fold line 110 forming a second side wall portion 120 extending generally between the second and the fourth fold lines 110 and 114. The third fold line 112 is spaced a distance from the fourth fold line 114 forming a base portion 122 extending generally between the third and the fourth fold lines 112 and 114.

In operation, the box insert 68*a* is initially folded along the third and fourth fold lines 112 and 114. In this position, the box insert 68a is inserted into the retaining space of a box constructed exactly like the box 14a shown in FIG. 3 and described in detail before. The first side wall portion 118 extends generally along and over the first end wall of the box 14a and the second side wall portion 120 extends along and over the second end wall of the box 14a.

The first fold line 108 is spaced a distance from the first end 100 of the box insert 68 forming a first lid flap 124. The second fold line 110 is spaced a distance from the second end 102 of the box insert 68 forming a second lid flap 126. When the box insert 68a is disposed in the retaining space 34a, the lid flap portions 124 and 126 each extend a distance above the open upper end 32a of the box 14a.

The box insert 68a includes adhesive 128 applied to a portion of the inner surface thereof. More particularly, the adhesive 128 comprises three adhesive strips 130, 132 and 134. Each of the adhesive strips 130, 132 and 134 extends generally between the first and the second ends 100 and 102 of the box insert 68. The adhesive strips 130, 132 and 134 each are spaced a distance apart.

After the box insert 68a has been disposed in the retaining space 34a, the floral grouping assemblies then are disposed in the retaining space 34a to a position wherein a portion of each of the floral grouping assemblies 18 removably and adhesively connects to at least one of the adhesive strips 130, 132 and 134 for removably and adhesively connecting each of the floral grouping assemblies to the box insert 68a for substantially preventing movement of the floral grouping assemblies in the box 14 a during movement or shipment of the box 14a. After the floral grouping assemblies have been disposed in the retaining space 34a, the lid flap portions 124 and 126 then are each folded generally along a respective fold lines 108 and 110 to a position wherein each of the lid flap portions 124 and 126 extends generally over the open upper end 32a of the box 14a. In this position, a portion of at least one of the adhesive strips 130, 132 and 134 on the respective lid flap portions 124 and 126 removably and adhesively connects to a portion of one of the floral grouping assemblies for substantially prevent movement of the floral grouping assemblies in the box 14a during movement Or shipment of the box 14a.

EMBODIMENT OF FIGS. 6 AND 7

Figure 6:
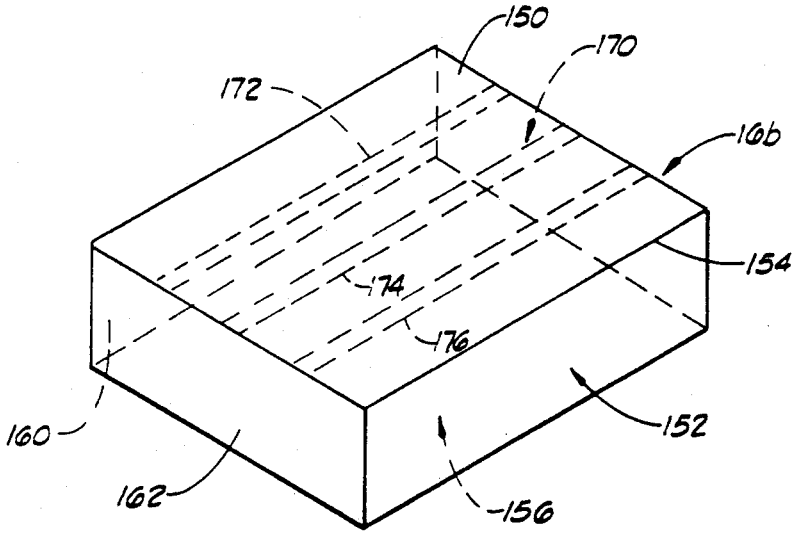
FIG. 6 is a partial elevational view of a modified box lid.
Figure 7:
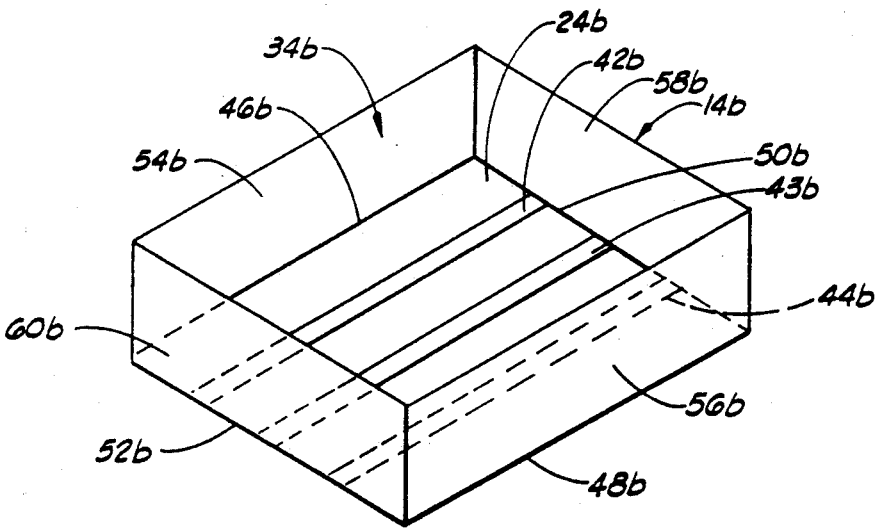
FIG. 7 is a partial elevational view of still another modified box which is used with the box lid shown in FIG. 6.

Shown in FIG. 6 is another modified box assembly. The box assembly includes a box 14b (FIG. 7) which is constructed exactly like the box 14 shown in FIGS. 1 and 2 and described in detail before, except the adhesive strips 42, 43 and 44 only extend over the base 24b and do not extend over the side walls 58b and 60b, and the box 14b does not. The box assembly 12b also includes a box lid 16b (FIG. 6) the box lid 16b has a base 150 and side walls 152. The side walls 152 are connected to the base 150 and extend generally about an entire outer periphery 154 of the base 150. The side walls 152 each extend generally perpendicularly from the base and cooperate with the base to form a box receiving space 156. The box lid 16b has an inner surface 160 and an outer surface 162. An adhesive 170 disposed on a portion of an inner surface 160 of the box lid 16b. The adhesive 170 more particularly comprises three adhesive strips 172, 174 and 176. The adhesive strips 172, 174 and 176 are spaced a distance apart.

In operation, the floral grouping assemblies are disposed in the retaining space 34b of the box 14b. The adhesive strips 42b, 43b and 44b each removably and adhesively connect the floral grouping assemblies 18 to the box 14b. The box lid 16b then is placed over the open upper end 32b of the box 14b to a position wherein the adhesive strips 172, 174 and 176 each removably and adhesively connect each of the floral grouping assemblies 18 to the box lid 166 for removably and adhesively connecting the floral grouping assemblies 18 to the box lid 166 for substantially preventing movement of the floral grouping assemblies 18 in the box 14b during movements or shipment of the box 14b.

EMBODIMENT OF FIGS. 8 AND 9

Figure 8:
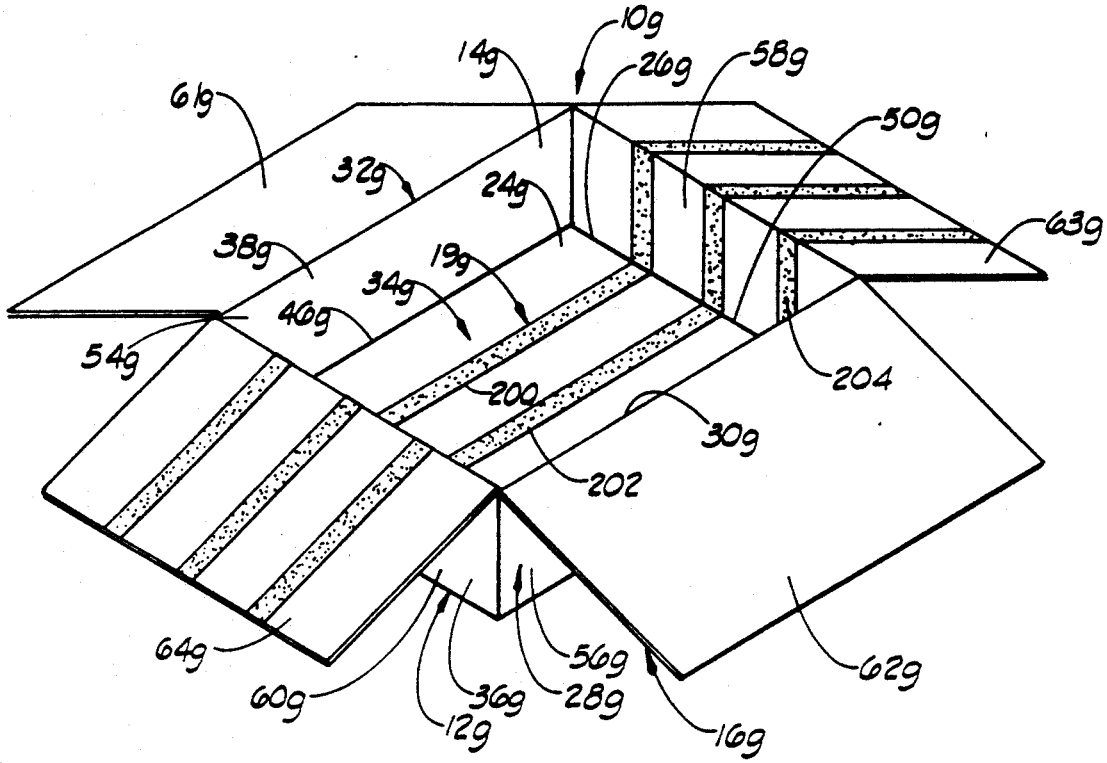
FIG. 8 is a partial perspective view of a box assembly similar to the box assembly shown in FIG. 1, except showing a cohesive on the box.
Figure 9:
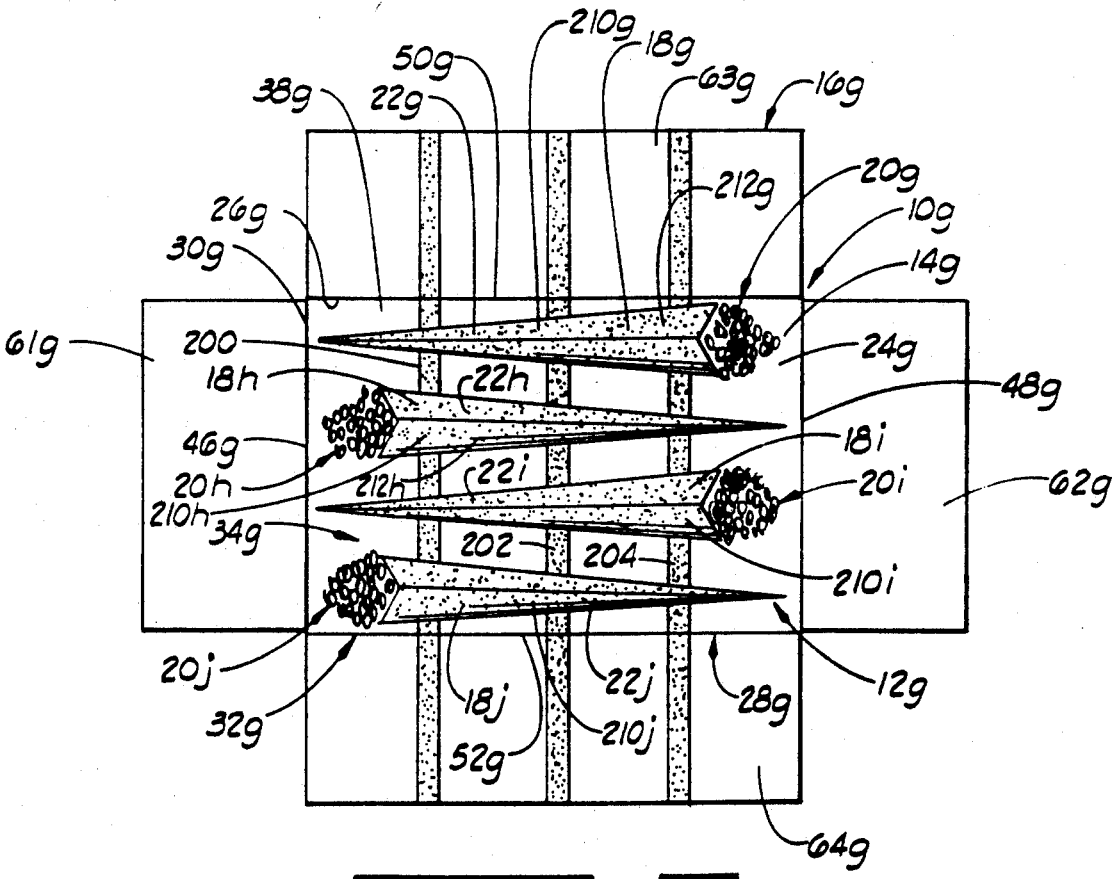
FIG. 9 is a partial elevational view of the box assembly of FIG. 8 showing a plurality of floral grouping assemblies disposed in the box.

Shown in FIGS. 8 and 9 is a shipping carton 10g which is constructed exactly like the shipping carton 10 shown in FIGS. 1 and 2, except the box assembly 12g does not include the adhesive 40 comprised of the adhesive strips 42, 43 and 44. Rather, the box 14g includes three strips of a cohesive with the individual strips being designated via the reference numerals 200, 202 and 204 in FIGS. 8 and 9. Each of the strips of cohesive 200, 202 and 204 are placed on the box assembly 12g exactly like the strips of adhesive 42, 43 and 44 on the box 12 shown in FIGS. 1 and 2 and described in detailed before.

The box assembly 12g is adapted to retain floral grouping assemblies 18g, 18h, 18i and 18j. Each floral grouping assembly 18g, 18h, 18i and 18j consists of a floral grouping 20g, 20h, 20i and 20j respectively with each floral grouping 20g, 20h, 20i and 20j being retained in a sleeve 22g, 22h, 22i and 22j respectively. The floral grouping assemblies 18g, 18h, 18i and 18j are constructed exactly like the floral grouping assemblies 18 shown in FIGS. 1 and 2, except each sleeve 22g, 22h, 22i and 22j includes an outer peripheral surface 210g, 210h, 210i and 210j respectively and a cohesive 212g, 212h, 212i and 212j is disposed on an outer surface of each of the sleeves 22g, 22h, 22i and 22j. In operation, the floral grouping assemblies 18g, 18h, 18i and 18j each are disposed in the retaining space 34g and positioned so that portions of the cohesive 212g, 212h, 212i and 212j on the respective sleeves 22g, 22h, 22i and 22j contacts portions of the cohesive 200, 202 and 204 for releasably and cohesively connecting each of the floral grouping assemblies 18g, 18h, 18i and 18j to the box 14g and the lid flaps 63g and 64g.

EMBODIMENT OF FIGS. 10 AND 11

Figure 10:
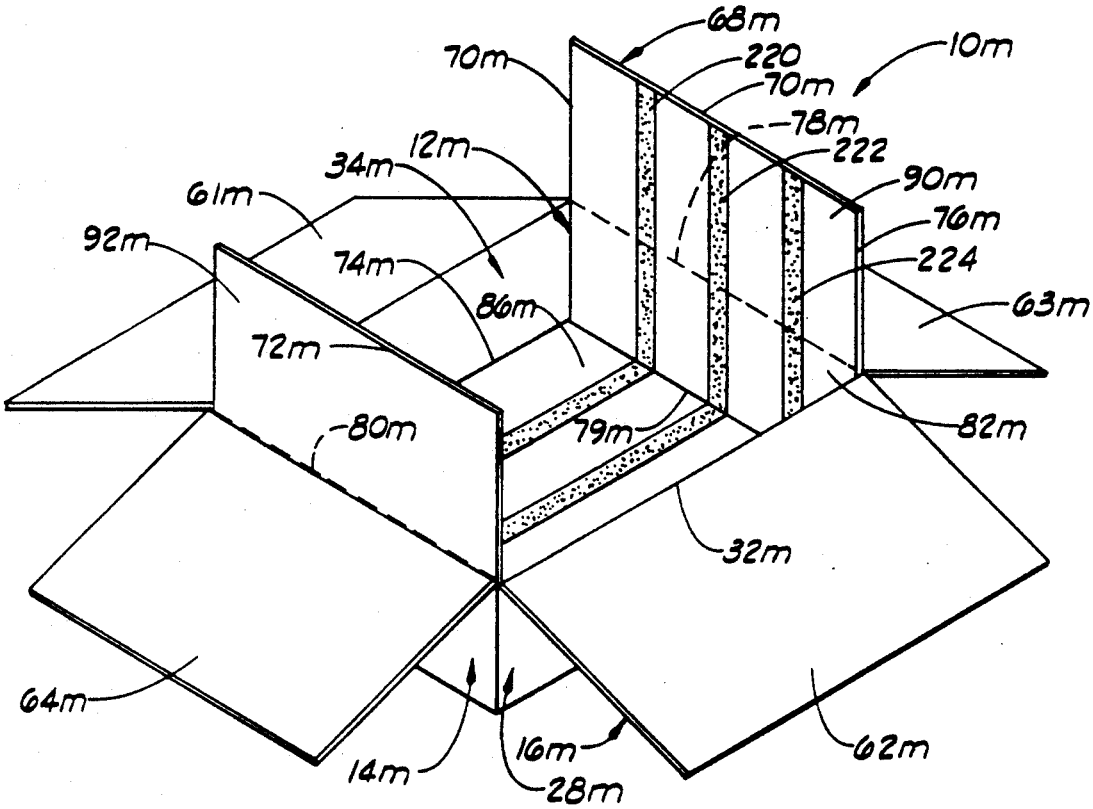
FIG. 10 is a partial elevational view of a modified box assembly, similar to the box assembly shown in FIG. 3, but showing a cohesive on the box insert.
Figure 11:
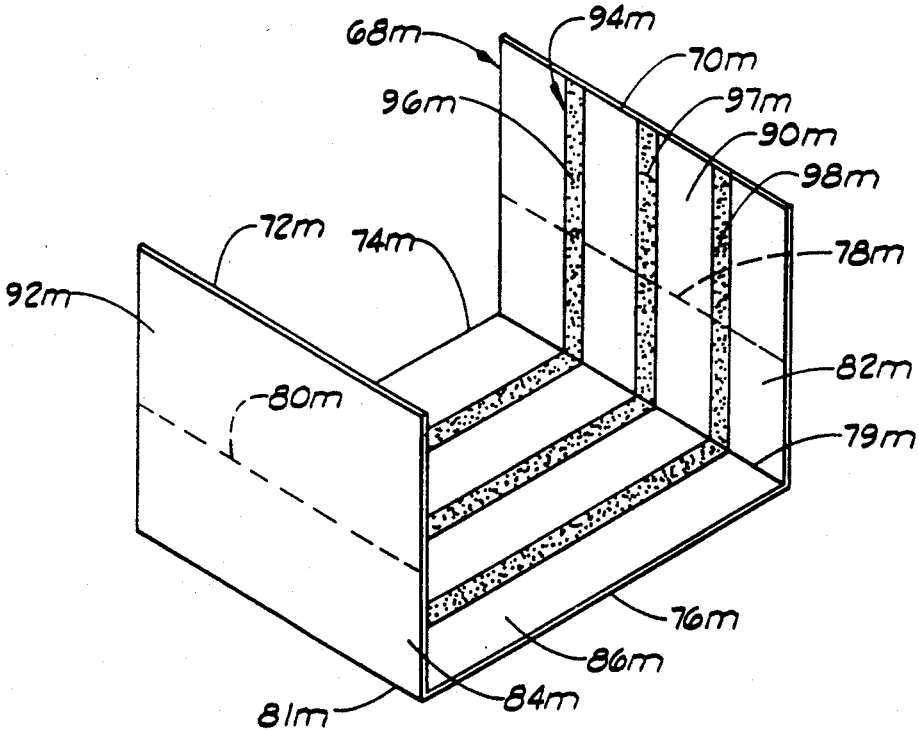
FIG. 11 is a partial elevational view of the box insert shown in FIG. 10.

Shown in FIGS. 10 and 11 is a shipping carton 10g which includes a box 14g and a box insert 68g which are constructed exactly like the box 14a and the box insert 68 shown in FIGS. 10 and 11 the adhesive 94. Rather, the box insert 68g includes three strips of cohesive 220, 222 and 224. The strips of cohesive 220, 222 and 224 are positioned and placed on the box insert 68g exactly like the strips of adhesive 96, 97 and 98 on the box insert 68 shown in FIGS. 3 and 4. In this embodiment, the floral grouping assemblies 18g, 18h, 18i and 18j shown in FIG. 9 are inserted into the retaining space 34g and the cohesive 212 on the sleeves 22 removably and cohesively connects to the cohesive strips 220, 222 and 224 for substantially preventing movement of the floral grouping assemblies 18 in the shipping carton 10m.

EMBODIMENT OF FIG. 12

Figure 12:
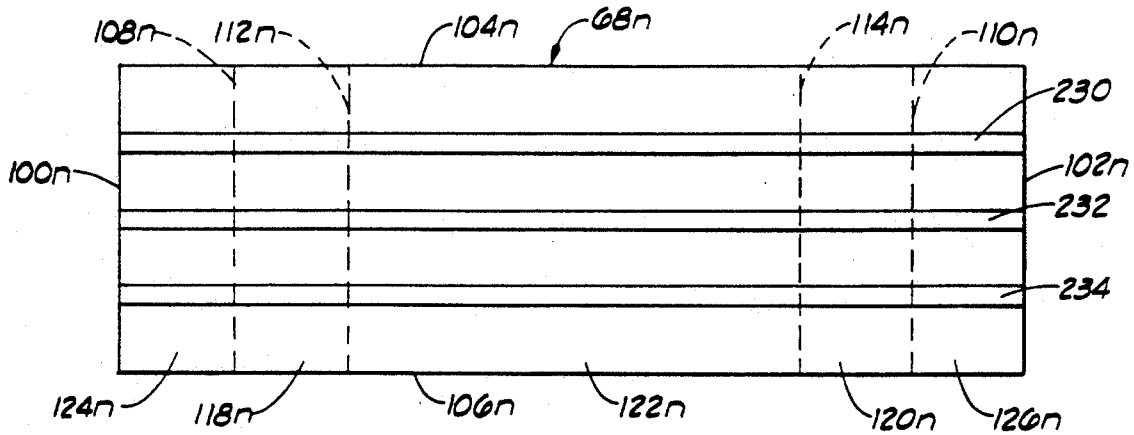
FIG. 12 is a plan view of a modified box insert, similar to FIG. 5, but showing a cohesive on the box insert.

Shown in FIG. 12 is a box insert 68n which is constructed exactly like the box insert 68a shown in FIG. 5 except the box insert 68m does not include the adhesive strips 130, 132 and 134. Rather, the box insert 68a includes cohesive strips 230, 232 and 234. The box insert 68*n* is inserted into the box in a manner exactly like that described before with respect to the box insert 68*a* shown in FIG. 5. The floral grouping assemblies 18*g*, 18*h*, 18*i* and 18*j* then are inserted into the retaining space where the cohesive strips 230, 232 and 234 cohesively and removably connect to the cohesive 212*g*, 212*h*, 212*i* and 212*j* on the sleeves 22.

EMBODIMENT OF FIGS. 13 AND 14

Figure 13:
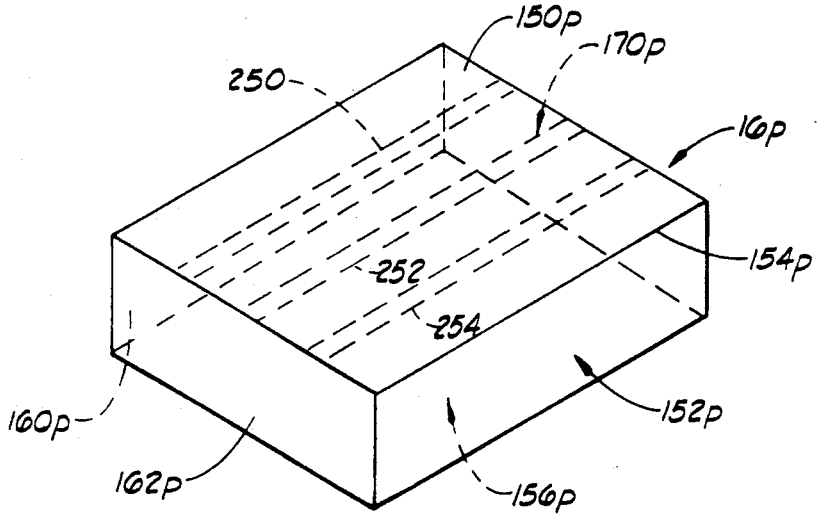
FIG. 13 is a partial elevational view of a modified box lid, similar to the box lid shown in FIG. 6, but showing a cohesive thereon.
Figure 14:
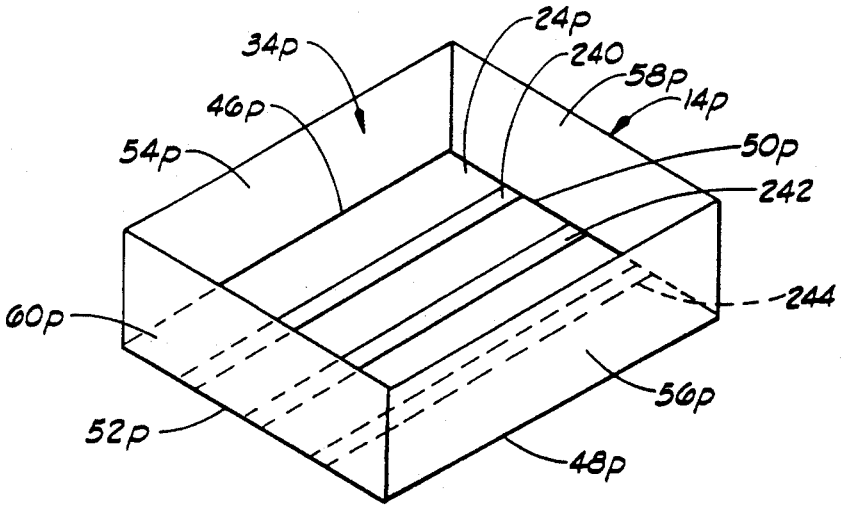
FIG. 14 is a partial elevational view of another modified box, similar to the box shown in FIG. 7, but showing a cohesive on the box, the box shown in FIG. 14 being used with the box lid shown in FIG. 13.

Shown in FIGS. 13 and 14 is a box 14*p* and a box lid 16*p* which are constructed exactly like the box 14*b* and the box lid 16*b* shown in FIGS. 13 and 14, except the box 14*b* does not include the adhesive strips 42*b*, 43*b* and 44*b* and the box lid 16*p* does not include the adhesive strips 172, 174 and 176. Rather, the box 14*p* includes cohesive strips 240, 242 and 244 and the box lid 16*p* includes cohesive strips 250, 252 and 254. When the floral grouping assemblies 18*g*, 18*h*, 18*i* and 18*j* are placed in the box 14*p* and the box lid 16*p* is disposed over the open upper end of the box 14*p*, the cohesive strips 240, 242 and 244 and the cohesive strips 250, 252 and 254 each will contact and cohesively connect to the sleeves 22*g*, 22*h*, 22*i* and 22*j* for preventing movement of the floral grouping assemblies 18 in the box 14*p*.

EMBODIMENT OF FIG. 15

Figure 15:
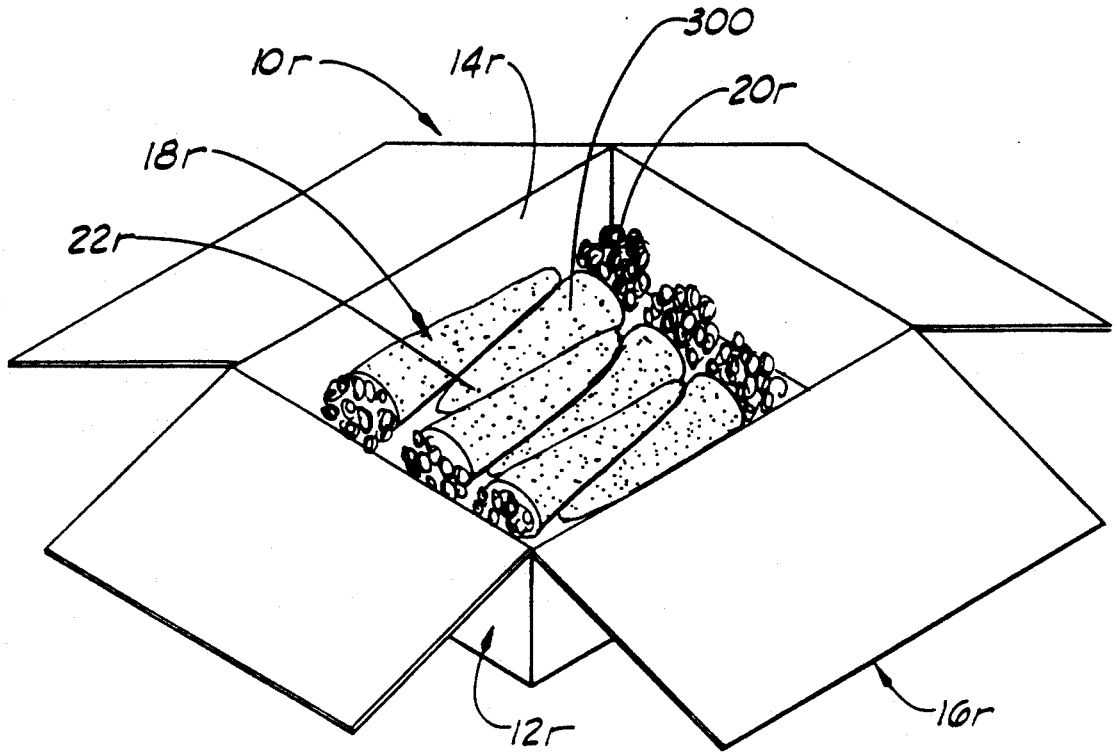
FIG. 15 is a perspective view of a modified box assembly having modified floral grouping assemblies disposed therein wherein the floral grouping assemblies have an adhesive or a cohesive material on a portion thereof.

Shown in FIG. 15 is a modified shipping carton 10*r* which includes a modified box assembly 12*r*. The modified box assembly 12*r* comprises a modified box 14*r* having a box lid 16*r* connected thereto. The box 14*r* is constructed exactly like the box 14 shown in FIG. 1 and the box lid 16*r* constructed exactly like the box lid 16*r* shown in FIG. 1, except the box 14*r* does not include an adhesive or cohesive on any portion thereof and the box lid 16*r* does not include adhesive or cohesive on any portion thereof.

As shown in FIG. 15, a plurality of floral grouping assemblies 18*r* are disposed in the box 14*r* (only one of the floral grouping assemblies 18*r* being designated with the reference numeral in FIG. 15). The floral grouping assemblies 18*r* each are constructed exactly like the floral grouping assemblies 18 shown in FIG. 1 and described in detailed before and each floral grouping assembly 18*r* includes a floral grouping 20*r* and a sleeve 22*r*, except the floral grouping assemblies 20*e* each include an adhesive or cohesive 300 disposed on a portion thereof. More particularly, the adhesive or cohesive 300 is disposed on the sleeve 22*r* of each floral grouping assembly 18*r*.

Assuming the material 300 is an adhesive, the adhesive 300 is disposed on each floral grouping assembly 18*r* such that, when the floral grouping assemblies 18*r* are disposed in the box 14*r*, the adhesive 300 on each floral grouping assembly 18*r* removably and adhesively engages a portion of the box assembly 12*r* and a portion of the adjacent floral grouping assembly 18*r* for removably connecting each of the floral grouping assemblies 18*r* to the box assembly 12*r* and/or adjacent floral grouping assemblies 18*r* for substantially preventing movement of the floral grouping assemblies 18*r* in the box assembly 12*r* during movements (shipment) of the box assembly 12*r*.

Assuming the material 300 is a cohesive, the cohesive 300 is disposed on each floral grouping assembly 18*r* such that, when the floral grouping assemblies 18*r* are disposed in the box assembly 12*r*, the cohesive 300 material on each floral grouping assembly 18*r* removably and cohesively engages the cohesive material 300 on adjacent floral grouping assemblies 18*r* for removably and cohesively connecting each floral grouping assembly 18*r* to adjacent floral grouping assemblies 18*r* for substantially preventing movement of the floral grouping assemblies 18*r* in the box assembly 12*r* during movements (shipment) of the box assembly 12*r*.

EMBODIMENT OF FIG. 16

Figure 16:
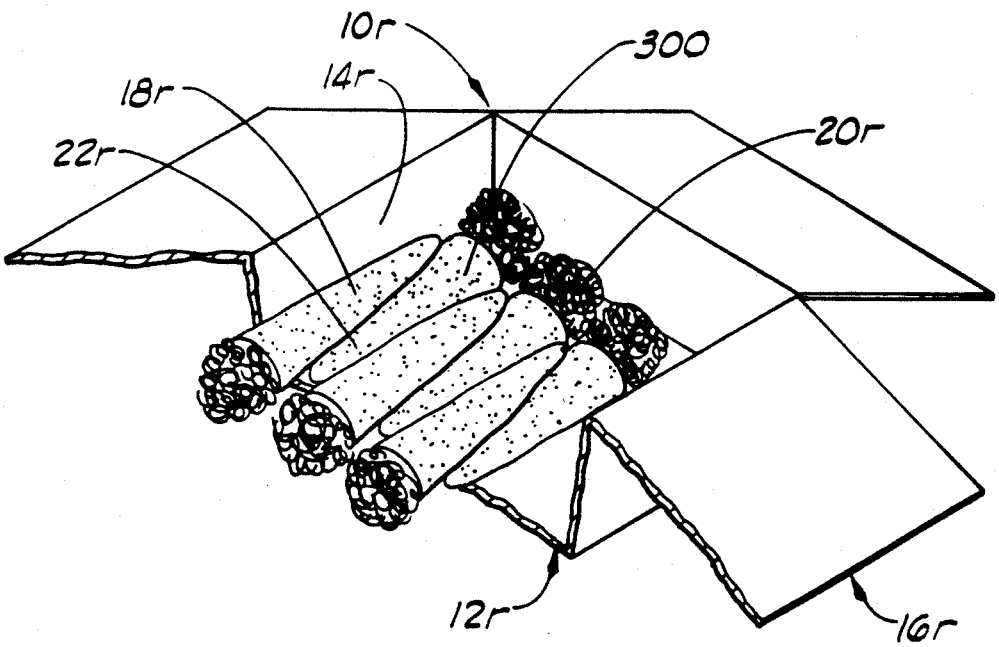
FIG. 16 is a view of another modified box assembly shown in cut away having floral grouping assemblies disposed therein, the floral grouping assemblies are constructed like the floral grouping assemblies shown in FIG. 15, except the floral grouping assemblies in FIG. 16 are shown layered with one layer of floral grouping assemblies being disposed on top of another layer of floral grouping assemblies.

Shown in FIG. 16 is a shipping carton 10*r* constructed exactly like the shipping carbon 10*r* shown in FIG. 15 with floral groupings 18*r* are disposed in the box 14*r*. The floral groupings 18*r* are constructed exactly like the floral groupings 18*r* are shown in FIG. 15 and include an adhesive or cohesive 300 disposed thereon. The only difference between the shipping carton 10*r* shown in FIG. 16 and the shipping carton shown in FIG. 15 is that the floral grouping assemblies 18*r* are shown in FIG. 16 disposed one on top of the other with a layer of floral grouping assemblies 18*r* being disposed near the bottom of the box and a second layer of floral grouping assemblies 18*r* being disposed on top of the first layer of floral grouping assemblies 18*r* disposed in the box 14*r*.

The floral grouping assemblies 18*r*, as shown in FIG. 16, will adhesively or cohesively adhere and connect to each other for substantially preventing movement of the floral grouping assemblies 18*r* in the box assembly 10*r* during movements (shipment) of the box assembly 12*r* in a manner like that described before with respect to the floral grouping assemblies 18*r* shown in FIG. 15.

EMBODIMENT OF FIGS. 17 AND 18

Figure 17:
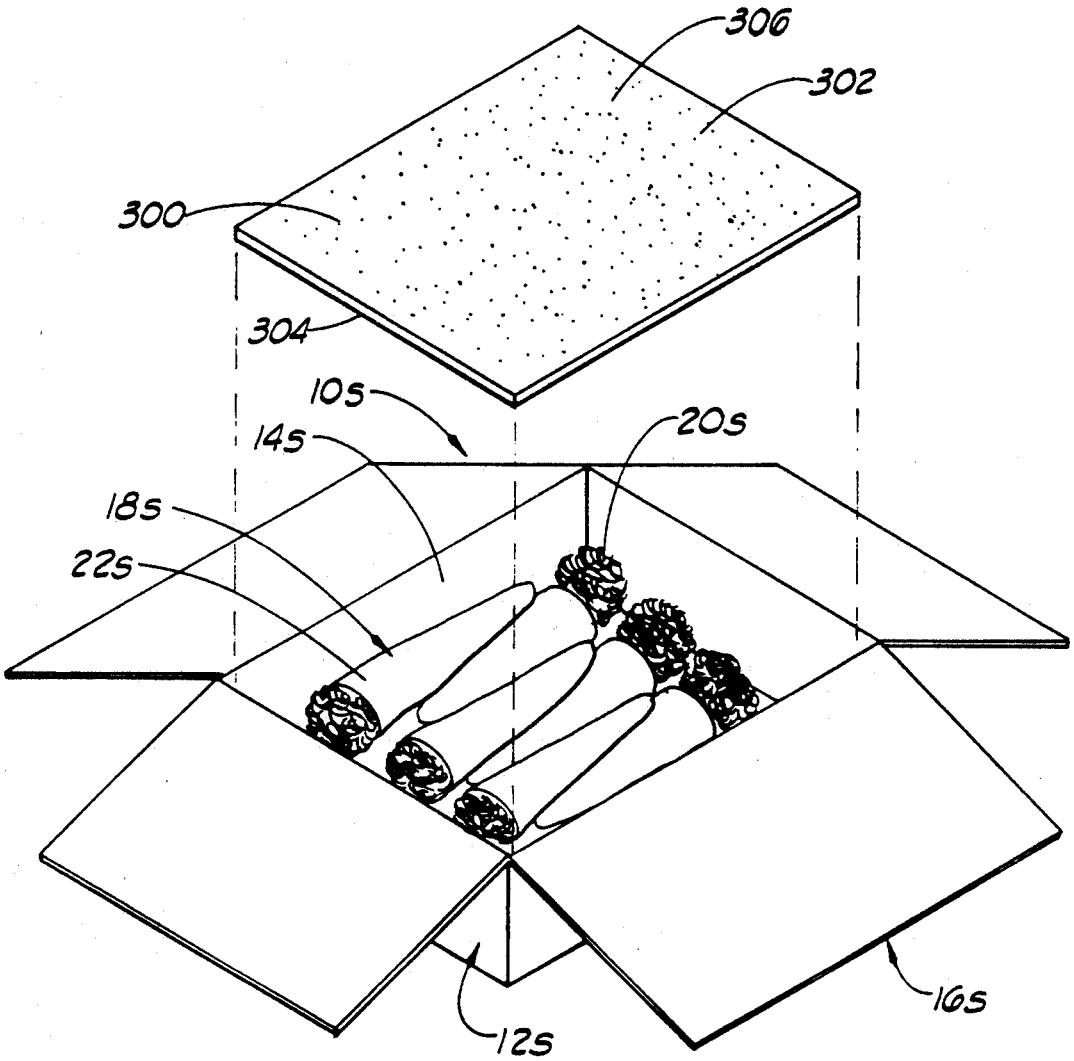
FIG. 17 is a perspective view of another modified box assembly showing floral grouping assemblies disposed therein wherein the box assembly includes a modified box insert, the box insert being shown in a position elevated above the box prior to the box insert being disposed in the box.

Shown in FIG. 17 is a shipping carton 10*s* which includes a box assembly 12*s* with floral grouping assemblies 18*s* disposed therein. The box assembly 12*s* is constructed exactly like the box assembly 12 shown in FIG. 1, except the box assembly 12*s* includes a box insert 300. The floral grouping assemblies 18*s* each are constructed like the floral grouping assemblies 18 shown in FIG. 2.

The box insert 300 includes an upper surface 302 and a lower surface 304. An adhesive 306 is disposed on the upper surface 302 of the box inset 300 and an adhesive 308 is disposed on the lower surface 304 of the box insert 300. The box insert 300 is rectangular or square shaped and is sized to fit in the retaining space of the box 14*s*.

In operation, the floral grouping assemblies 18*s* are disposed in the retaining space in the box 14*s* and the box insert 300 is disposed in the retaining space of the box 14*s* and positioned so that the lower surface 304 of the box insert 300 is disposed adjacent the floral grouping assemblies 18*s* whereby the adhesive 308 on the lower surface 304 of the box insert 300 adhesively engages a portion of the floral grouping assemblies 18*s* thereby adhesively and removably connecting each of the floral grouping assemblies 18*s* to the box insert 300 for substantially preventing movement of the floral grouping assemblies 18*s* in the box assembly 12*s* during movements (shipment) of the box assembly 12*s*.

As mentioned before, the box insert also includes an adhesive 306 on the upper surface 302 thereof. Thus, additional floral grouping assemblies 18*s* (not shown) can be placed on the upper surface 302 of the box insert 300 and positioned so that the adhesive 306 on the upper surface 302 removably and adhesively connects each of the floral grouping assemblies 18*s* to the upper surface 302 of the box insert 300 thereby substantially preventing movement of the floral grouping assemblies 18s in the box assembly 12s during movements (shipment) of the box assembly 12s.

EMBODIMENT OF FIGS. 19 AND 20

Figure 18:
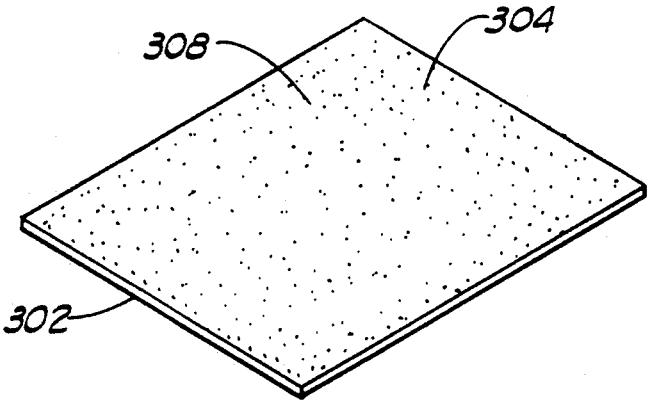
FIG. 18 is a partial perspective view of the box insert of FIG. 17, but showing the opposite side of the box insert.
Figure 19:
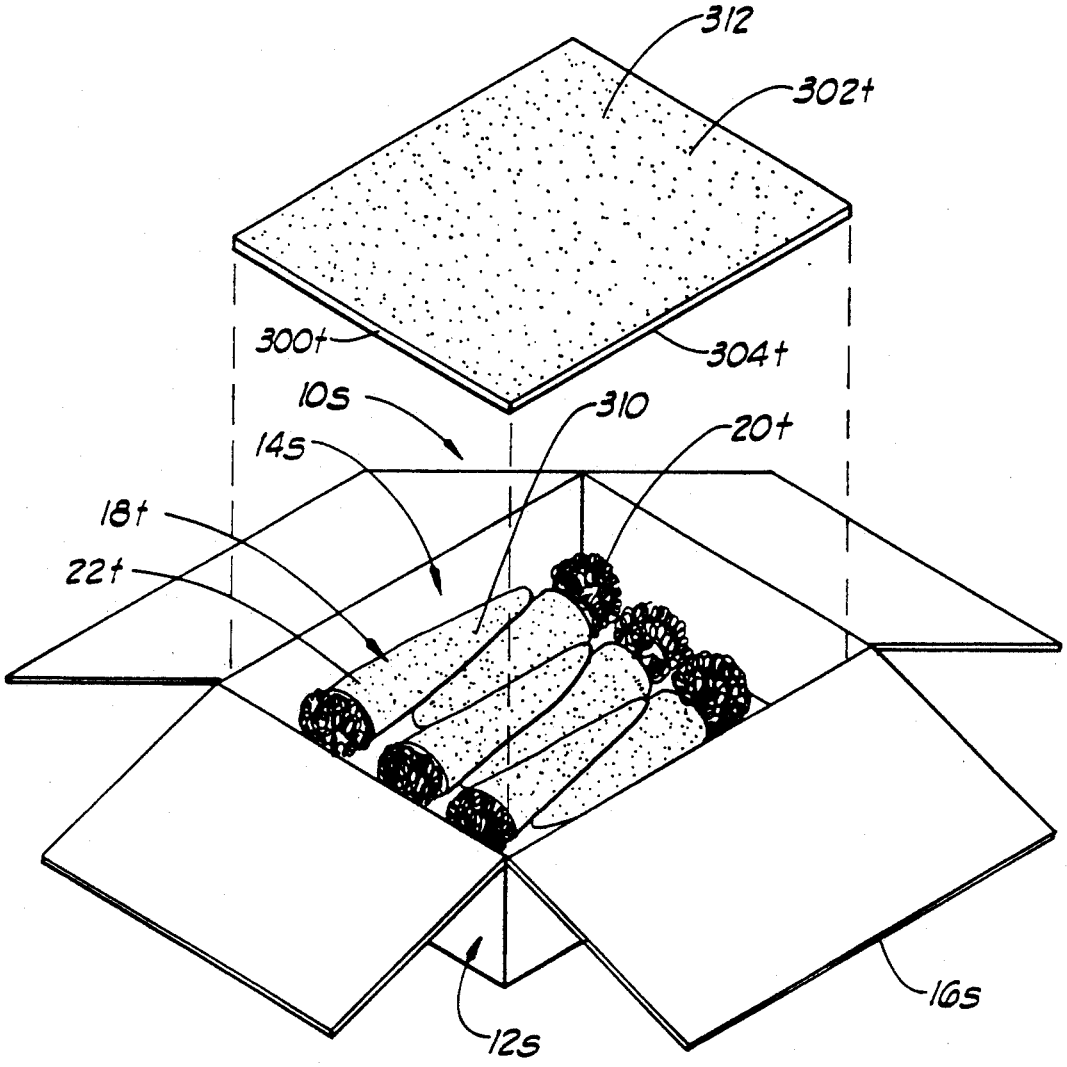
FIG. 19 is a perspective view showing another modified box assembly with floral grouping assemblies disposed therein wherein the box assembly and the floral grouping assemblies are constructed exactly like the box assembly and floral grouping assembly shown in FIGS. 17 except the floral grouping assemblies shown in FIG. 19 include a cohesive disposed on a portion thereof.
Figure 20:
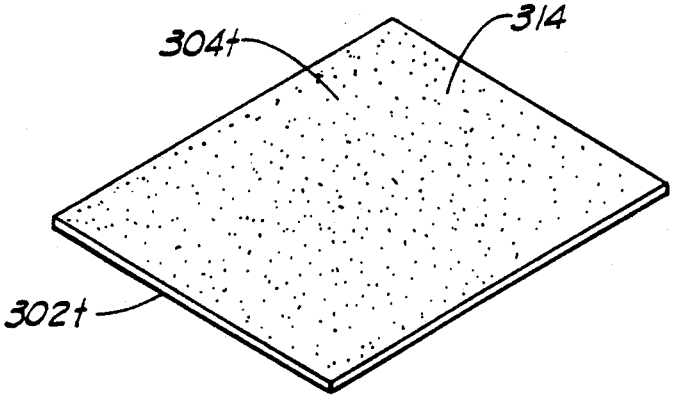
FIG. 20 is a perspective view of the box insert of the box assembly shown in FIG. 19.

Shown in FIG. 19 is a modified shipping carton 10s which includes the modified box assembly 12s comprising the modified box 14s with the lid assembly 16s. The box assembly 12s is constructed exactly like the box assembly 12s shown in FIGS. 17 and 18 and described in detailed before.

A plurality of floral grouping assemblies 18t are disposed in the retaining space of the box 14s. The floral grouping assemblies 18t are constructed exactly like the floral grouping assemblies 18s shown in FIG. 17 and described before, except the floral grouping assemblies 18t each include a cohesive 310 disposed thereon. More particularly, the cohesive 310 is disposed on the sleeve 22s surrounding a portion of each of the floral groupings 20t.

The box assembly 12s also includes a modified insert 300t. The box insert 300t is constructed exactly like the box insert 300 shown in FIGS. 17 and 18, except the box insert 300t includes a cohesive 310 on the upper surface 302 thereof and a cohesive 312 on the lower surface 304 thereof.

The floral grouping assemblies 18t are disposed in the retaining space of the box assembly 14s and the box insert 300t then is disposed in the retaining space of the box 14s and positioned so that a portion of the cohesive 312 on the lower surface 304t thereof cohesively engages a portion of the cohesive 310 on each of the floral grouping assemblies 18t thereby cohesively and removably connecting each of the floral grouping assemblies 18t to the box insert 300t for substantially preventing movement of the floral grouping assemblies 18t during movements (shipment) of the box assembly 12s.

The box insert 300t also includes a cohesive 312 on the upper surface 302 thereof. When the box insert 300t is disposed on the floral grouping assemblies 18t additional floral grouping assemblies 18t may be placed on the upper surface 302t of the box insert 300t. The cohesive on each of these additional floral grouping assemblies 18t would engage and cohesively contact the cohesive 312 on the upper surface 302 of the box insert 300 for cohesively and removably connecting each of the floral grouping assemblies to the upper surface 302 of the box insert 300t.

EMBODIMENT OF FIGS. 21, 22 AND 23

Figure 21:
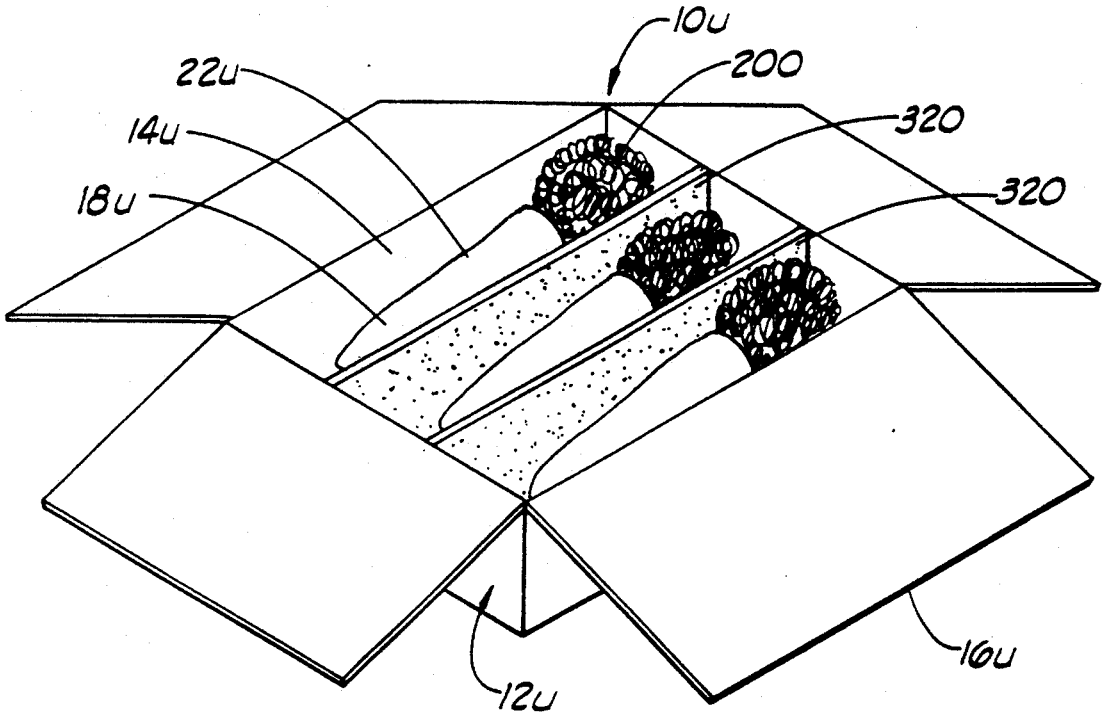
FIG. 21 is a perspective view of another modified box assembly having modified box inserts disposed therein.

Shown in FIG. 21 is a modified shipping carton 10u which includes a modified box assembly 12u which is constructed like the box assembly 12s shown in FIG. 21, except the box assembly 12u shown in FIG. 19 includes a plurality of box inserts 320. The box assembly 12u has a plurality of floral grouping assemblies 18u disposed in a retaining space portion thereof with the floral grouping assemblies 18u each being constructed exactly like the floral grouping assemblies 18s shown in FIG. 17.

Figure 22:
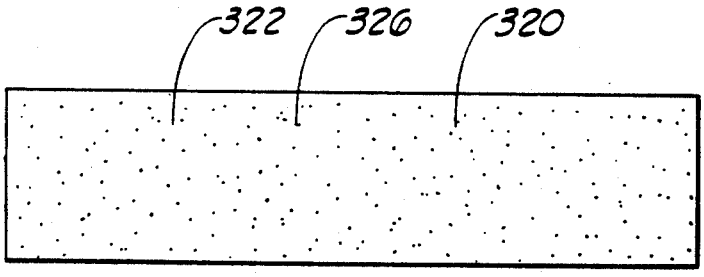
FIG. 22 is an elevational view of a typical box insert constructed like the box insert shown in FIG. 19.
Figure 23:
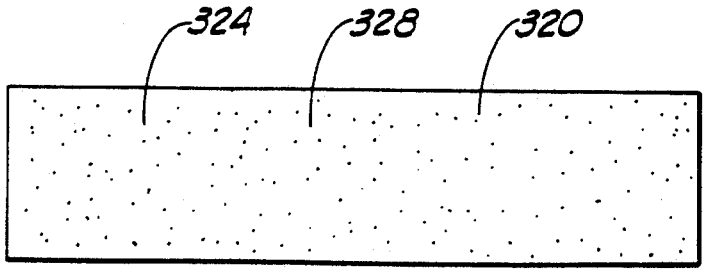
FIG. 23 is an elevational view of the box insert of FIG. 22, but showing the opposite side of the box insert as compared to the side shown in FIG. 22.

The box insert 320 are identical in construction and a typical box insert 320 is shown in FIGS. 22 and 23. Each box insert 320 includes a first side 322 and a second side 324. An adhesive 326 is disposed on the first side 322 of each box insert 320. An adhesive 328 is disposed on the second side 324 of each box insert 320.

In operation, the box inserts 320 are disposed in the retaining space of the box 14u with the box inserts 320 being spaced a distance apart. The box inserts 320 are disposed between adjacent floral grouping assemblies 18u and positioned so that a portion of the adhesives 326 and 328 on the first and the second sides 322 or 324 of each box insert 320 engages a portion of adjacent floral grouping assemblies 18u to adhesively connect each of the floral grouping assemblies 18u to at least one of the box inserts 320 for substantially preventing movement of the floral grouping assemblies 18u in the box assembly 12u during movements (shipment) of the box assembly 12u. A portion of each box insert 320 engages a portion of the box assembly 12u to substantially prevent movement of the box insets 320 in the box assembly 12u.

EMBODIMENT OF FIGS. 24, 25 AND 26

Figure 24:
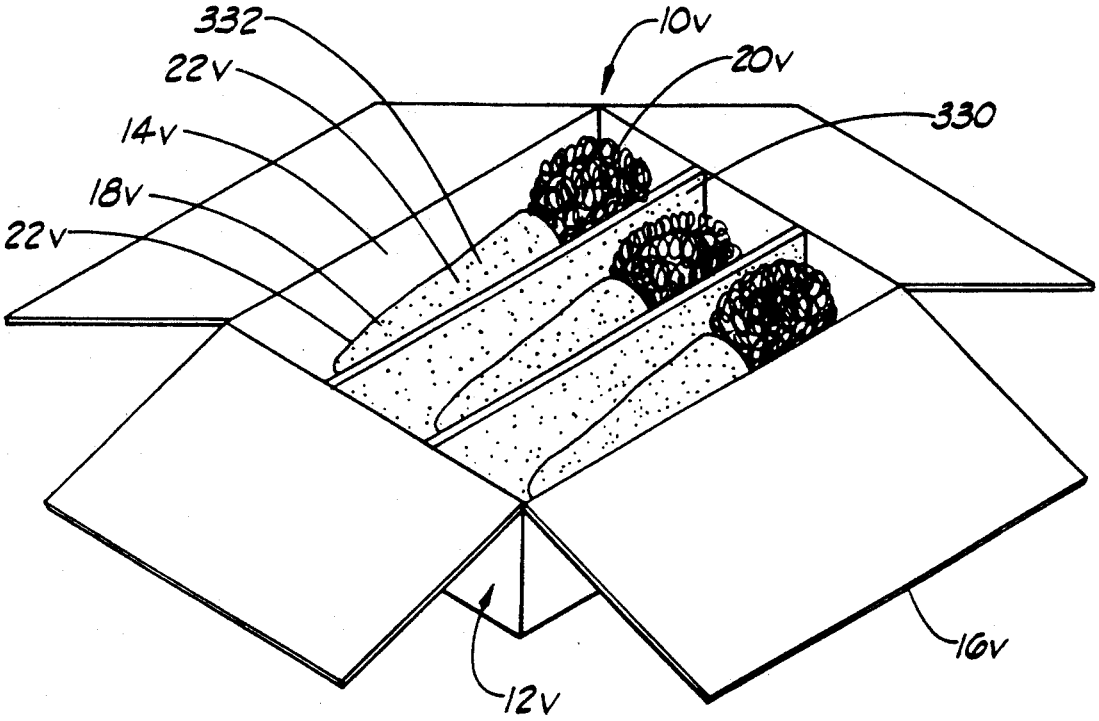
FIG. 24 is a perspective view of a box assembly similar to the box assembly shown in FIG. 21 except the box inserts include a cohesive disposed on a portion thereof and the floral grouping assemblies disposed in the box assembly each have a cohesive disposed on a portion thereof.
Figure 25:
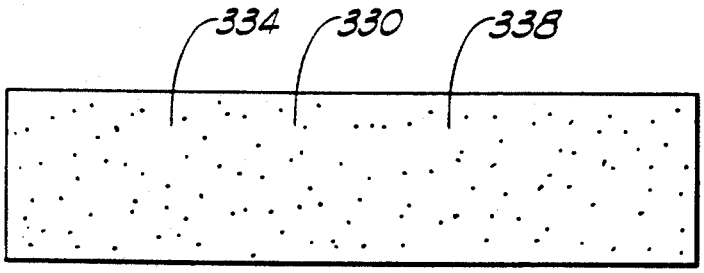
FIG. 25 is a plan view showing the upper surface of a typical box insert.
Figure 26:
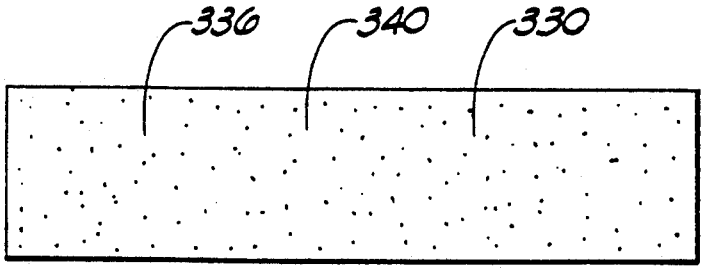
FIG. 26 is a plan view showing the lower surface of the box insert of FIG. 24.

Shown in FIG. 24 is a modified shipping carton 10v. The shipping carton 10v includes a box assembly 12v which is constructed exactly like the box assembly 12u shown in FIG. 21 and described before, except the box assembly 12v includes a plurality of modified box inserts 330 disposed in the retaining space portion of the box 14v. A plurality of floral grouping assemblies 18v are disposed in the retaining space of the box 14v of the floral grouping assemblies 18e each are constructed exactly like the floral grouping assemblies 18u shown in FIG. 21, except the floral grouping assemblies 18v each include a cohesive 332 disposed on a portion thereof. More particularly, the cohesive 332 is disposed on the sleeve 22v of each of the floral grouping assemblies 18v.

Each box insert 330 is rectangular or square shaped and has an upper surface 334 and a lower surface 336. A cohesive 338 is disposed on the upper surface 334 of each box insert 330. A cohesive 340 is disposed on the lower surface 336 of each box insert 330.

Each box insert 330 is disposed in the retaining space of the box 14v and disposed between two f the floral grouping assemblies 18v to a position wherein each box insert 330 engages a portion of the box assembly 12v for permitting movement of the box insert 330 during shipment of the box assembly 12v. Each box insert 330 is positioned so that the cohesive 338 on the upper surface 334 engages the cohesive 332 on one of the floral grouping assemblies 18v and so that the cohesive 340 on the lower surface 336 of each box insert 330 engage the cohesive 332 on one of the floral grouping assemblies 18v for cohesively connecting each of the floral grouping assemblies 18v to at least one of the box inserts 330 for substantially preventing movements of the floral grouping assemblies 18v during movements (shipment) of the box assembly 12v.

The term "sleeve" as used herein simply means a sheet of material adapted to be wrapped about a floral grouping and includes sheets of material performed to provide a warp and sheets of material which are hand or otherwise formed about floral groupings.

Changes may be made in the construction and the operation of the various components, elements and assemblies described herein without departing from the spirit and scope of the invention as defined in the following claims.

What is claimed is:

1. A shipping carton comprising:

a box assembly having an inner surface and an outer surface and at least partially enclosing a retaining space; and a floral grouping assembly disposed in the retaining space in the box assembly and the floral grouping assembly having an adhesive disposed on a portion thereof with the adhesive on the floral grouping assembly removably and adhesively engaging a portion of the box assembly and connecting to the floral grouping assembly to the box assembly when the floral grouping assembly is placed in the retaining space in the box assembly for substantially preventing movement of the floral grouping assembly in the box assembly during movements of the box assembly.

2. The shipping carton of claim 1 wherein the box assembly further comprises:

a box having a base, side walls, an outer surface, an inner surface, the side walls being connected to the base and extending a distance upwardly from the base, the side walls extending about an outer periphery of the base and cooperating with the base to partially enclose the retaining space.

3. The shipping carton of claim 2 wherein the base of the box comprises a first end, a second end, a first side and a second side.

4. The shipping carton of claim 3 wherein the side walls comprise a first end wall extending along the first end of the base, a second end wall extending along the second end of the base, a first side wall extending along a first side of the base and a second side wall extending along the second side of the base.

5. The shipping carton of claim 2 wherein the side walls extend upwardly from the base forming an open upper end of the box, and wherein the box assembly further comprises:

a box lid removably connectable to the open upper end of the box, the box lid cooperating with the side walls and the base to encompass the retaining space in a closed position.

6. The shipping carton of claim 1 wherein the floral grouping assembly comprises:

a floral grouping;

a sheet of material disposed about at least a portion of the floral grouping, the adhesive being disposed on the sheet of material.

7. A shipping carton, comprising:

a box assembly having an inner surface and an outer surface and at least partially enclosing a retaining space comprising:

a box insert having an upper surface and a lower surface with an adhesive being disposed on the lower surface; and a floral grouping assembly disposed in the retaining space in the box assembly and the box insert being disposed in the retaining space in the box assembly with the adhesive on the box insert adhesively engaging the floral grouping assembly for adhesively and removably connecting each of the floral grouping assembly to the box insert for substantially preventing movement of the floral grouping assembly in the box assembly during movements of the box assembly.

8. The shipping carton of claim 7 wherein the box assembly further comprises:

a box having a base, side walls, an outer surface, an inner surface, the side walls being connected to the base and extending a distance upwardly from the base, the side walls extending about an outer periphery of the base and cooperating with the base to partially enclose the retaining space.

9. The shipping carton of claim 8 wherein the base of the box comprises a first end, a second end, a first side and a second side.

10. The shipping carton of claim 9 wherein the side walls comprise a first end wall extending along the first end of the base, a second end wall extending along the second end of the base, a first side wall extending along a first side of the base and a second side wall extending along the second side of the base.

11. The shipping carton of claim 10 wherein the side walls extend upwardly from the base forming an open upper end of the box, and wherein the box assembly further comprises:

a box lid removably connectable to the open upper end of the box, the box lid cooperating with the side walls and the base to encompass the retaining space in a closed position.

12. The shipping carton of claim 7 wherein the box insert is defined further as having an adhesive disposed on the upper surface thereof.

13. The shipping carton of claim 7 wherein the box insert is further defined as engaging portions of the box assembly when the box insert is disposed in the box assembly for substantially preventing movement of the box insert in the box assembly.

14. A shipping carton comprising:

a box assembly having an inner surface and an outer surface and at least partially enclosing a retaining space, comprising;

a box insert having an upper surface and a lower surface, the box insert having a cohesive on the lower surface thereof; and a floral grouping assembly disposed in the retaining space in the box assembly and the floral grouping assembly having a cohesive disposed on a portion thereof, the box insert being disposed in the retaining space in the box assembly with the cohesive on the box insert cohesively and removably engaging the cohesive on the floral grouping assembly for removably and cohesively connecting the floral grouping assembly to the box insert for substantially preventing movement of the floral grouping assembly in the box assembly during movement of the box assembly.

15. The shipping carton of claim 14 wherein the box assembly further comprises:

a box having a base, side walls, an outer surface, an inner surface, the side walls being connected to the base and extending a distance upwardly from the base, the side walls extending about an outer periphery of the base and cooperating with the base to partially enclose the retaining space.

16. The shipping carton of claim 15 wherein the base of the box comprises a first end, a second end, a first side and a second side.

17. The shipping carton of claim 16 wherein the side walls comprise a first end wall extending along the first end of the base, a second end wall extending along the second end of the base, a first side wall extending along a first side of the base and a second side wall extending along the second side of the base.

18. The shipping carton of claim 17 wherein the side walls extend upwardly from the base forming an open upper end of the box, and wherein the box assembly further comprises:

a box lid removably connectable to the open upper end of the box, the box lid cooperating with the side walls and the base to encompass the retaining space in a closed position.

19. The shipping carton of claim 14 wherein the box insert is defined further as having a cohesive on the upper surface thereof.

20. The shipping carton of claim 14 wherein the box insert is defined further as being sized to engage portion of the box assembly when the box insert is disposed in the retaining space in the box assembly for substantially preventing movement of the box insert in the box assembly during movements of the box assembly.

21. The shipping carton of claim 14 wherein the box insert is defined further as being disposed in the retaining space above the floral grouping assemblies.

22. The shipping carton of claim 14 wherein the box insert is defined further as being disposed in the retaining space of the box assembly and disposed between adjacent floral grouping assemblies.

23. A shipping carton comprising:

a box assembly having an inner surface and an outer surface and partially enclosing a retaining space, the box assembly having an adhesive disposed on a portion thereof; and a floral grouping assembly being disposed in the retaining space in the box assembly, the adhesive on the box assembly being positioned for removably and adhesively engaging and connecting the floral grouping assembly to the box assembly when the floral grouping assembly is placed in the retaining space in the box assembly for substantially preventing movement of the floral grouping assembly in the box assembly during movements of the box assembly.

24. The shipping carton of claim 23 wherein the box assembly further comprises:

a box having a base, side wall, an outer surface, an inner surface, the side walls being connected to the base and extending a distance upwardly form the base, the side walls extending about an outer periphery of the base and cooperating with the base to partially enclose the retaining space, the adhesive being applied to the inner surface of the base.

25. The shipping carton of claim 24 wherein a portion of the adhesive is applied to an inner surface of the side walls.

26. The shipping carton of claim 24 wherein the adhesive comprises at least one strip of adhesive disposed on the base.

27. The shipping carton of claim 26 wherein each strip of adhesive also is disposed on the inner surface of the side walls.

28. The shipping carton of claim 24 wherein the base of the box comprises a first end, a second end, a first side and a second side, and wherein the adhesive comprises at least one strip of adhesive extending between the first and the second sides of the base.

29. The shipping carton of claim 28 wherein the side walls comprise a first end wall extending along the first end of the base, a second end wall extending along the second end of the base, a first side wall extending along the first side of the base and a second side wall extending along the second side of the base, and wherein each adhesive strip further comprises a portion extending along the first side and another portion extending along the second side wall.

30. The shipping carton of claim 24 wherein the side walls extend upwardly from the base forming an open upper end of the box, and wherein the box assembly further comprises:

a box lid removably connectable to the open upper end of the box, the box lid cooperating with the side walls and the base to encompass the retaining space in a closed position.

31. The shipping carton of claim 30 wherein the adhesive further comprises adhesive disposed on a portion of the box lid, the adhesive on the box lid removably and adhesively engaging and connecting the floral grouping assemblies to the box lid in the closed position of the box lid.

32. The shipping carton of claim 23 wherein the box assembly further comprises:

a box having a base, side walls, an outer surface, an inner surface, the side walls being connected to the base and extending a distance upwardly from the base, the side walls extending about an outer periphery of the base and cooperating with the base to partially enclose the retaining space in a closed position, the side walls extending upwardly from the base forming an open upper end of the box, and wherein the box assembly further comprises:

a box lid removably connectable to the open upper end of the box, the box lid cooperating with the side walls and the base to encompass the retaining space, the adhesive being disposed on the box lid and the adhesive removably and adhesively engaging and connecting the floral grouping assembly to the box lid in the closed position of the box lid.

33. The shipping carton of claim 24 wherein the base comprises a first end, a second end, a first side, and a second side, and wherein the side walls further comprise a first end wall, second end wall, first side wall and a second wall, the first end wall extending generally along the first end of the base, the second end wall extending generally along the second end of the base, the first side wall extending generally along the first side of the base and the second side wall extending generally along the second side of the base, and wherein a portion of the adhesive is disposed on the inner surface of the base and a portion of the adhesive is disposed on the inner surface of the first side and a portion of the adhesive is disposed on the inner surface of the second side wall.

34. The shipping carton of claim 23 wherein the box assembly further comprises:

a box, comprising a base having an outer periphery, and side walls connected to the base and extending generally about the outer periphery of the base, the side walls extending generally upwardly from the base forming an open upper end and cooperating with the base to partially encompass the retaining space; and a box lid having an inner surface and an outer surface, the box lid being removably connectable to the open upper end of the box, a portion of the adhesive being disposed on the inner surface of the box lid and positioned whereby the adhesive removably and adhesively engages the floral grouping assembly is disposed in the retaining space in the closed position of the box lid.

35. The shipping carton of claim 23 wherein the box assembly further comprises:

a box, comprising a base having an outer periphery, and side walls connected to the base, the side walls extending generally about the outer periphery of the base and extending a distance from the base, the side walls cooperating with the base to partially encompass the retaining space; and a box insert having an inner surface and an outer surface, at least a portion of the adhesive being disposed on the inner surface of the box insert, the box insert being disposable in the box and cooperating with the box for forming the retaining space, the floral grouping assembly being disposed in the retaining space and the adhesive on the box insert engaging and adhesively connecting the floral grouping assembly to the box insert for substantially preventing movements of the floral grouping assembly in the box during movement of the box.

36. The shipping carton of claim 35 wherein the base comprises a first end, a second end, a first side and a second side, and wherein the side walls further comprise a first end wall, second end wall, first side wall and a second wall, the first end wall extending generally along the first end of the base, the second end wall extending generally along the second end of the base, the first side wall extending generally along the first side of the base and the second side wall extending generally along the second side of the base, and wherein the box insert includes a first fold line spaced a distance from the first side of the box insert, a second fold line spaced a distance from the second side of the box insert, a third fold line spaced a distance from the first fold line and a fourth fold line spaced a distance from the second fold line, the first and the third foldlines being spaced a distance apart and the space therebetween forming a first side wall portion, the second and the fourth fold lines being spaced a distance apart and the distance therebetween forming a second side wall portion, the portion of the box insert between the first foldline and the first side of the box insert forming a first lid flap portion and the portion of the box insert between the second fold line and the second side of the box insert forming a second lip flap portion of the box insert, the portion of the box insert between the third fold line and the fourth fold line forming a base portion, the box insert being foldable on the third and the fourth foldlines and in this position the box insert being disposed in the box to a position wherein the base portion of the box insert is disposed generally adjacent the base of the box and the first side wall portion of the box insert extends over the first side wall of the box and the second side wall portion of the box insert extends generally over the second side wall of the box, the box insert cooperating with the box to form the retaining space, the adhesive being disposed on the box insert, the floral grouping assembly being disposed in the retaining space to a position wherein the floral grouping removably and adhesively contacts and engages the adhesive on the box insert for substantially preventing movement of the floral grouping assembly during movement of the box, the first lid flap portion formed on the box insert being foldable along the first fold line to a position extending over a portion of the retaining space and the second lip flap portion of the box insert being foldable on the second fold line to a position wherein the second lip flap portion of the box insert extends over a portion of the retaining space.

37. The shipping carton of claim 36 wherein the adhesive on the box insert comprises at least on strip of adhesive extending between the first and the second fold lines of the box insert.

38. The shipping carton of claim 36 wherein the adhesive comprises at least one strip of adhesive extending generally between the first side and the second side of the box insert.

39. The shipping carton of claim 35 wherein the base comprises a first end, a second end, a first side, and a second side, and wherein the side walls further comprise a first end wall, second end wall, first side wall and a second wall, the first end wall extending generally along the first end of the base, the second end wall extending generally along the second end of the base, the first side wall extending along the first side of the base and the second side wall extending generally along the second side of the base, and wherein the box insert further comprises a first side, a second side, a first end and a second end, and wherein the box insert includes a first fold line spaced a distance from the first end of the box insert, a second fold line spaced a distance from the second end of the box insert, a third fold line spaced a distance from the first fold line and a fourth fold line spaced a distance from the second fold line, the first and the third fold line being spaced a distance apart and the space therebetween forming a first side wall portion, the second and the fourth fold lines being spaced a distance apart and the distance therebetween forming a second side wall portion, the portion of the box insert between the first fold line and the first end of the box insert forming a first lid flap portion and the portion of the box insert between the second fold line and the second end of the box insert forming a second lip flap portion of the box insert, the portion of the box insert between the third fold line and the fourth fold line forming a base portion, the box insert being foldable on the third and the fourth fold lines and in this position the box insert being disposed in the box to a position wherein the base portion of the box insert is disposed adjacent the base of the box and the first side wall portion of the box insert extends over the first end wall of the box and the second side wall portion of the box insert extends over the second end wall of the box, the box insert cooperating with the box to form the retaining space, the adhesive being disposed on the box insert, the floral grouping assembly being disposed in the retaining space to a position wherein the floral grouping assembly removably and adhesively contacts and the engages the adhesive on the box insert for substantially preventing movement of the floral grouping assembly during movement of the box, the first flap portion formed on the box insert being foldable along the first fold line to a position extending over a portion of the retaining space and the second lip flap portion of the box insert being foldable on the second fold line to a position wherein the second flap portion of the box insert extends over a portion of the retaining space.

40. The shipping carton of claim 39 wherein the adhesive on the box insert comprises at least one strip of adhesive extending between the first and the second fold lines of the box insert.

41. The shipping carton of claim 39 wherein the adhesive comprises at least one strip of adhesive extending generally between the first end and the second end of the box insert.

42. The shipping carton comprising:

a box assembly having an inner surface and an outer surface and partially enclosing a retaining space, the box assembly having a cohesive disposed on a portion thereof; and a floral grouping assembly being disposed in the retaining space in the box assembly and the floral grouping assembly having a cohesive on a portion thereof, the cohesive on the box assembly being positioned for removably and cohesively engaging the cohesive on the floral grouping assembly for connecting the floral grouping assembly to the box assembly when the floral grouping assembly is placed in the retaining space in the box assembly for substantially preventing movement of the floral grouping assembly in the box assembly during movements of the box assembly.

43. The shipping carton of claim 42 wherein the box assembly further comprises:

a box having a base, side walls, an outer surface, an inner surface, the side walls being connected to the base and extending a distance upwardly from the base, the side walls extending about an outer periphery of the base and cooperating with the base to partially enclose the retaining space, the cohesive being applied to the inner surface of the base.

44. The shipping carton of claim 43 wherein a portion of the cohesive is applied to an inner surface of the side walls.

45. The shipping carton of claim 43 wherein the cohesive comprises at least one strip of cohesive disposed on the base.

46. The shipping carton of claim 45 wherein each strip of cohesive also is disposed on the inner surface of the side walls.

47. The shipping carton of claim 43 wherein the base of the box comprises a first end, a second end, a first side and a second side, and wherein the cohesive comprises at least one strip of cohesive extending between the first and the second sides of the base.

48. The shipping carton of claim 47 wherein the side walls comprises a first end wall extending along the first end of the base, a second end wall extending along the second end of the base, a first side wall extending along the first side of the base and a second side wall extending along the second side of the base, and wherein each cohesive strip further comprises a portion extending along the first side wall and another portion extending along the second side wall.

49. The shipping carton of claim 43 wherein the side walls extend upwardly from the base forming the open upper end of the box, and wherein the box assembly further comprises:

a box lid removably connectable to the open upper end of the box lid cooperating with the side walls and the base to encompass the retaining space in a closed position.

50. The shipping carton of claim 49 wherein the cohesive further comprises cohesive disposed on a portion of the box lid, the cohesive on the box lid removably and cohesively engaging the cohesive on the floral grouping assembly for connecting the floral grouping assembly to the box lid in the closed position of the box lid.

51. The shipping carton of claim 42 wherein the box assembly further comprises:

a box having a base, side walls, an outer surface, an inner surface, the side walls being connected to the base and extending a distance upwardly from the base, the side walls extending about an outer periphery of the base and cooperating with the base to partially enclose the retaining space in a closed position, the side walls extending upwardly from the base forming an open upper end of the box, and wherein the box assembly further comprises:

a box lid removably connectable to the open upper end of the box, the box lid cooperating with the side walls and the base to encompass the retaining space, the cohesive being disposed on the box lid and the cohesive removably and cohesively engaging the cohesive on the floral grouping assembly for connecting the floral grouping assembly to the box lid in the closed position of the box lid.

52. The shipping carton of claim 43 wherein the base comprises a first end, a second end, a first side, and a second side, and wherein the side walls further comprise a first end wall, second end wall, first side wall and a second wall, the first end wall extending generally along the first end of the base, the second end wall extending generally along the second end of the base, the first side wall extending generally along the first side of the base and the second side wall extending generally along the second side of the base, and wherein a portion of the cohesive is disposed on the inner surface of the base and a portion of the cohesive is disposed on the inner surface of the first side wall and a portion of the cohesive is disposed on the inner surface of the second side wall.

53. The shipping carton of claim 42 wherein the box assembly further comprises:

a box, comprising a base having an outer periphery, and side walls connected to the base and extending generally about the outer periphery of the base, the side walls extending generally upwardly from the base forming an open upper end and cooperating with the base to partially encompass the retaining space; and a box lid having an inner surface and an outer surface, the box lid being removably connectable to the open upper end of the box, a portion of the cohesive being disposed on the inner surface of the box lid and positioned whereby the cohesive removably and cohesively engages the cohesive on the floral grouping assembly when the floral grouping assembly is disposed in the retaining space in the closed position of the box lid.

54. The shipping carton of claim 42 wherein the box assembly further comprises:

a box, comprising a base having an outer periphery, and side walls connected to the base, the side walls extending generally about the outer periphery of the base and extending a distance from the base, the side walls cooperating with the base to partially encompass the retaining space; and a box insert having an inner surface and an outer surface, at least a portion of the adhesive being disposed on the inner surface of the box insert, the box insert being disposable in the box and cooperating with the box for forming the retaining space, the floral grouping assembly being disposed in the retaining space and the cohesive on the box insert engaging the cohesive on the floral grouping assembly for cohesively connecting the floral grouping to the box insert for substantially preventing movements of the floral grouping assembly in the box during movement of the box.

55. The shipping carton of claim 54 wherein the base comprises a first end, a second end, a first side, and a second side, and wherein the side walls further comprise a first end wall, second end wall, first side wall and a second wall, the first end wall extending generally along the first end of the base, the second end wall extending generally along the second end of the base, the first side wall extending generally along the first side of the base and the second side wall extending generally along the second side of the base, and wherein the box insert further comprises a first side, a second side, a first end and a second end and wherein, the box insert includes a first fold line spaced a distance from the first side of the box insert, a second fold line spaced a distance from the second side of the box insert, a third fold line spaced a distance from the first fold line and a fourth fold line spaced a distance from the second fold line, the first end and the third fold lines being spaced a distance apart and the space therebetween forming a first side wall portion, the second and the fourth fold lines being spaced a distance apart and the distance therebetween forming a second side wall portion, the portion of the box insert between the first fold line and the first side of the box insert forming a first lip flap portion and the portion of the box insert between the second fold line and the second side of the box insert forming a second lid flap portion of the box insert, the portion of the box insert between the third fold line and the fourth fold line forming a base portion, the box insert being foldable on the third and the fourth fold lines and in this position the box insert being disposed in the box to a position wherein the base portion of the box insert is disposed generally adjacent the base of the box and the first side wall portion of the box insert extends over the first side wall of the box and the second side wall portion of the box insert extends generally over the second said wall of the box, the box insert cooperating with the box to form the retaining space, the cohesive being disposed on the box insert, the floral grouping assembly being disposed in the retaining space to a position wherein the cohesive on the floral grouping assembly removably and cohesively contacts and engages the adhesive on the box insert for substantially preventing movement of the floral grouping assembly during movement of the box, the first lid flap portion formed on the box insert being foldable along the first fold line to a position extending over a portion of the retaining space and the second lid flap portion of the box insert being foldable on the second fold line to a position wherein the second lip flap portion of the box insert extends over a portion of the retaining space.

56. The shipping carton of claim 55 wherein the cohesive on the box insert comprises at least one strip of cohesive extending between the first and the second fold lines of the box insert.

57. The shipping carton of claim 55 wherein the cohesive comprises at least one strip of cohesive extending generally between the first side and the second side of the box insert.

58. The shipping carton of claim 55 wherein the base comprises a first end, a second end, a first side, and a second side, and wherein the side walls further comprise a first end wall, second end wall, first side wall and a second wall, the first end wall extending generally along the first end of the base, the second end wall extending generally along the second end of the base, the first side wall extending along the first side of the base and the second side wall extending generally along the second sides of the base, and wherein the box insert further comprises a first side, a second side, a first end and a second end, and wherein the box insert includes a first fold line spaced a distance from the first end of the box insert, a second fold line spaced a distance from the second end of the box insert, a third fold line spaced a distance from the first fold line and a fourth fold line spaced a distance from the second fold line, the first and the third fold line being spaced a distance apart and the space therebetween forming a first side wall portion, the second and the fourth fold lines being spaced a distance apart and the distance therebetween forming a second side wall portion, the portion of the box insert between the first fold line and the first end of the box insert forming a first lid flap portion and the portion of the box insert between the second fold line and the second end of the box insert forming a second lid flap portion of the box insert, the portion of the box insert between the third fold line and the fourth fold line forming a base portion, the box insert being foldable on the third and the fourth fold lines and in this position the box insert being disposed in the box to a position wherein the base portion of the box insert is disposed adjacent the base of the box and the first side wall portion of the box insert extends over the first end wall of the box and the second side wall portion of the box insert extends over the second end wall of the box, the box insert cooperating with the box to form the retaining space, the cohesive being disposed on the box insert, the floral grouping assembly being disposed in the retaining space to a position wherein the cohesive on the floral grouping assembly removably and cohesively contacts and engages the cohesive on the box insert for substantially preventing the movement of the floral grouping assembly during movement of the box, the first flap portion formed on the box insert being foldable along the first fold line to a position extending over a portion of the retaining space and the second lip flap portion of the box insert being foldable on the second fold line to a position wherein the second flap portion of the box insert extends over a portion of the retaining space.

59. The shipping carton of claim 58 wherein the cohesive on the box insert comprises at least one strip of cohesive extending between the first and the second fold lines of the box insert.

60. The shipping carton of claim 58 wherein the cohesive comprises at least one strip of cohesive extending generally between the first end and the second end of the box insert.

* * * * *

UNITED STATES PATENT AND TRADEMARK OFFICE

CERTIFICATE OF CORRECTION

PATENT NO. : 5,240,109

DATED : Aug. 31, 1993

INVENTOR(S) : Weder et al.

It is certified that error appears in the above-identified patent and that said Letters Patent is hereby corrected as shown below:

Column 1, line 9, after the year "1992,", please insert --now U.S. Pat. No. 5,148,918, issued Sept. 22, 1992,--.

Column 3, line 3, after the word "therein", please insert the punctuation --.--.

Column 3, line 23, after the word "add", please delete the letter "t" and substitute therefore the word --to--.

Column 3, line 63, please delete the word "walls", and substitute therefore the word --wall--.

Column 4, line 41, please delete the word "groupings", and substitute therefore the words --grouping assemblies--.

Column 4, line 50, please delete the number "22", and substitute therefore the number --20--.

Column 5, line 47, please delete the word "include", and substitute therefore the word --includes--.

Column 5, line 53, please delete the words "and the second".

Column 6, line 20, please delete the word "line", and substitute therefore the word --lines--.

UNITED STATES PATENT AND TRADEMARK OFFICE

CERTIFICATE OF CORRECTION

PATENT NO. : 5,240,109

DATED : Aug. 31, 1993

INVENTOR(S) : Weder et al.

It is certified that error appears in the above-identified patent and that said Letters Patent is hereby corrected as shown below:

Column 7, line 32, please delete the space between the number "14" and the letter "a".

Column 7, line 36, after the word "along", please delete the word "a".

Column 7, line 45, please delete the word "Or", and substitute therefore the word --or--.

Column 8, line 7, please delete the number "166", and substitute therefore the number --16b--.

Column 8, line 9, please delete the number "166", and substitute therefore the number --16b--.

Column 8, line 17, please delete the number "40", and substitute therefore the number --19--.

Column 8, line 23, after the word "box", please insert the word --assembly--.

Column 9, line 44, please delete the word "detailed", and substitute therefore the word --detail--.

Column 9, line 46, please delete the number "20e" and substitute therefore the number --18r--.

UNITED STATES PATENT AND TRADEMARK OFFICE

CERTIFICATE OF CORRECTION

PATENT NO. : 5,240,109

DATED : Aug. 31, 1993

INVENTOR(S) : Weder et al.

It is certified that error appears in the above-identified patent and that said Letters Patent is hereby corrected as shown below:

Column 10, line 12, please delete the word "groupings", and substitute therefore the words --grouping assemblies--.

Column 10, line 13, please delete the word "groupings", and substitute therefore the words --grouping assemblies--.

Column 10, line 14, please delete the word "groupings", and substitute therefore the words --grouping assemblies--.

Column 10, line 29, please delete the number "10r" and substitute therefore the number --12r--.

Column 11, line 53, please delete the number "21" and substitute therefore the number --19--.

Column 11, line 54, please delete the number "19" and substitute therefore the number --21--.

Column 12, line 23, please delete the number "18e" and substitute therefore the number --18v--.

Column 12, line 53, please delete the word "warp", and substitute therefore the word --wrap--.

Column 15, line 34, please delete the word "wall" and substitute therefore the word --walls--.

UNITED STATES PATENT AND TRADEMARK OFFICE

CERTIFICATE OF CORRECTION

PATENT NO. : 5,240,109

DATED : Aug. 31, 1993

INVENTOR(S) : Weder et al.

It is certified that error appears in the above-identified patent and that said Letters Patent is hereby corrected as shown below:

Column 17, line 27, please delete the word "foldlines" and substitute therefore the words --fold lines--.

Column 17, line 32, please delete the word "foldline" and substitute therefore the words --fold line--.

Signed and Sealed this

Ninth Day of August, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,240,109
DATED : August 31, 1993
INVENTOR(S) : Weder et al.

It is certified that error appears in the above-identified patent and that said Letters Patent is hereby corrected as shown below:

Title page,
[*] Notice: after the word "to", please delete "March 3, 2009" and substitute therefore "April 26, 2011".

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*